US009509081B2

(12) United States Patent
Kobayashi et al.

(10) Patent No.: US 9,509,081 B2
(45) Date of Patent: Nov. 29, 2016

(54) CONNECTOR

(71) Applicant: YAZAKI CORPORATION, Minato-ku, Tokyo (JP)

(72) Inventors: Naoki Kobayashi, Shizuoka (JP); Akihiro Tsuruta, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/951,849

(22) Filed: Nov. 25, 2015

(65) Prior Publication Data

US 2016/0079699 A1 Mar. 17, 2016

Related U.S. Application Data

(63) Continuation of application No. PCT/JP2014/064095, filed on May 28, 2014.

(30) Foreign Application Priority Data

May 30, 2013 (JP) ..... 2013-113797

(51) Int. Cl.
*H01R 13/502* (2006.01)
*H01R 13/506* (2006.01)
*H01R 13/629* (2006.01)

(52) U.S. Cl.
CPC ..... *H01R 13/502* (2013.01); *H01R 13/506* (2013.01); *H01R 13/629* (2013.01); *H01R 13/62938* (2013.01)

(58) Field of Classification Search
CPC ..... H01R 13/502; H01R 13/62933; H01R 13/6293; H01R 13/62944; H01R 13/6295; H01R 13/62955; H01R 13/62961
See application file for complete search history.

(56) References Cited

U.S. PATENT DOCUMENTS

| | | | |
|---|---|---|---|
| 5,437,558 | A | 8/1995 | Sakuraoka et al. |
| 2006/0046540 | A1 | 3/2006 | Ikeya et al. |
| 2006/0205264 | A1 | 9/2006 | Katsuma |
| 2008/0102667 | A1 | 5/2008 | Ikeya et al. |
| 2009/0203248 | A1 | 8/2009 | Matsumura et al. |

FOREIGN PATENT DOCUMENTS

| | | | |
|---|---|---|---|
| JP | H06-231833 | A | 8/1994 |
| JP | H09-219235 | A | 8/1997 |
| JP | 2000-195610 | A | 7/2000 |
| JP | 2006-073330 | A | 3/2006 |
| JP | 2006-253074 | A | 9/2006 |
| JP | 2007-317442 | A | 12/2007 |
| JP | 2008-108662 | A | 5/2008 |
| JP | 2009-187865 | A | 8/2009 |

*Primary Examiner* — Ross Gushi
(74) *Attorney, Agent, or Firm* — Mots Law, PLLC

(57) ABSTRACT

Provided is a connector that has a male connector that includes a male terminal and a locking section, an aligning plate that engages with the male terminal in order to protect the male terminal, that is freely movable with respect to the male terminal, that is provided with an engaged portion and a locked portion that is provided to a surface on the proximal end side of the male terminal, and that is configured so that movement toward the proximal end side of the male terminal is blocked in a state in which the aligning plate is provisionally mounted on the male connector; and a female connector that has an engaging portion that engages with the engaged portion of the aligning plate when the female connector is removed from the male connector, and that moves together with the aligning plate in a direction leading away from the male connector.

3 Claims, 29 Drawing Sheets

CONNECTOR

CROSS REFERENCE TO RELATED APPLICATIONS

This application is a Continuation of PCT Application No. PCT/JP2014/064095, filed on May 28, 2014, and claims the priority of Japanese Patent Application No. 2013-113797, filed on May 30, 2013, the content of both of which is incorporated herein by reference.

BACKGROUND

Technical Field

The present invention relates to a connector, and more particularly to a connector having an aligning plate.

Background Art

Conventionally, there has been known a connector (lever fitting type connector) 301 shown in FIGS. 1 to 2B (see JP 2006-073330 A).

The connector 301 includes a female housing (female connector, female connector housing) 303, a male housing (male connector, male connector housing) 305, a moving plate 307, and a lever 309.

The moving plate 307 includes: a plate body 308 in which terminal insertion holes (insertion holes) 311 are formed; and a plurality of temporary locking portions 310 formed on the plate body 308 and temporarily locked to the female housing 303.

The temporary locking portions 310 are arranged on a plurality of straight lines which are orthogonal to a rotational axis of the lever 309 fitted in the female housing 303 such that the temporary locking portions 310 are positioned on both sides of the rotational axis.

The mounting of the male housing 305 and the moving plate 307 on the female housing 303 is performed as follows.

The moving plate 307 is set on the male housing 305. At this stage of operation, male terminal fittings (male terminals) 315 which project in the inside of a hood part 313 of the male housing 305 are respectively inserted into the terminal insertion holes 311 formed in the moving plate 307 in a corresponding manner.

Next, joining surfaces of the female housing 303 and the male housing 305 are brought into contact with each other, and are temporarily locked to each other by the temporary locking portions 310. Then, the lever 309 is inserted into the lever insertion hole 317 from a female housing 303 side with a distal end side inserted first. At this stage of operation, the lever 309 is temporarily locked to the female housing 303.

Next, by rotating operating portions 319, 321 of the temporarily locked lever 309 in a counterclockwise direction, distal end portions of screw grooves 323, 325 accommodate engaging projections 329 of a lever engaging plate 327, and the female housing 303 and the male housing 305 are engaged with each other by fitting engagement by being pulled to each other.

Then, at the time of completion of fitting engagement between the female housing 303 and the male housing 305, as shown in FIG. 2A, a locking projection 333 of a repulsive member 331 arranged on a side of the lever insertion hole 317 formed in the female housing 303 is locked to a distal end portion of the temporary locking member 335 of the moving plate 307 thus holding the moving plate 307. At the same time, as shown in FIG. 2B, a locking projection 339 formed in a projecting manner on a repulsive member 337 formed on an outer side wall of the fitting portion of the female housing 303 locks a distal end portion of the temporary locking member 341 of the moving plate 307 thus holding the moving plate 307.

Conventionally, there has been also known a connector (a connector equipped with an aligning plate) 351 shown in FIGS. 3 to 5 (see JP 2009-187865 A).

The connector 351 equipped with an aligning plate includes a connector housing (male connector) 353 having a fitting space 355, and an aligning plate 359 movably arranged in the fitting space 355 and positioning a male terminal 357 at a prescribed position. In the inside of the connector housing 353, a temporary locking hook 367 which holds a plate portion 365 of the aligning plate 359 formed of an arm portion 361 and a projecting portion 363 at a temporary locking position is mounted. An indentation 369 formed on a surface of the plate portion 365 as a result of the plate portion 365 being forcibly pressed to a depth side of the fitting space 355 by a hand of an operator or a connector other than a fitting counterpart is brought into pressure contact with the projecting portion 363 and hence, a contact portion N which is in contact with an inner surface of the indentation 369 is formed where a vector P2 which pulls the arm portion 361 toward the inside of the fitting space is generated.

Further, as a connector having an aligning plate, conventionally, there has been known a connector described in JP 2000-195610 A.

SUMMARY OF THE INVENTION

However, the connector 301 described in JP 2006-073330 A and the connector described in JP 2000-195610 A have a drawback that when a large load is applied to the aligning plate, the aligning plate is pushed into the connector. For example, when the aligning plate is pushed into the housing on a male housing side with a large force, in the configuration shown in FIGS. 2A and 2B, a temporary locking state of the aligning plate is easily released so that the aligning plate is moved toward the male housing.

In the connector 351 described in JP 2009-187865 A and the connector described in JP 2000-195610 A, the structure for lifting the aligning plate is not provided and hence, there exists a drawback that it is difficult to remove the aligning plate once mounted on the male housing from the male housing.

The present invention has been made in view of the above-mentioned drawbacks, and it is an object of the present invention to provide a connector having a male connector, a female connector, and an aligning plate, wherein the aligning plate is not moved toward the male connector even when a strong force (load) is applied in a temporarily locked state, and the aligning plate, once mounted, can be easily removed from the male connector.

A connector according to the present invention includes a male connector, an aligning plate, and a female connector, wherein the male connector includes a male terminal and a locking portion, the aligning plate is configured such that the aligning plate engages with the male terminal so as to perform at least one of the protection of the male terminal and the correction of alignment of the male terminal, the aligning plate is movable relative to the male connector in a projecting direction of the male terminal, the aligning plate includes a engaged portion and a locked portion formed on a surface faced to a proximal end side of the male terminals, and the locked portion is brought into contact with the locking portion of the male connector in a state where the aligning plate is temporarily mounted in the male connector thus preventing the movement of the male terminal toward the proximal end, and the female connector is configured such that the female connector is mounted on the male connector together with the aligning plate by moving toward the male connecter side, the female connector includes an engaging portion, and in removal of the female connector from the male connector due to the movement of the female connector toward a side away from the male connector from a state where the female connector is mounted on the male connector, the engaging portion engages with the engaged portion of the aligning plate, and the aligning plate is moved toward a side away from the male connector.

The connector according to the present invention may be configured such that in the removal of the female connector from the male connector due to the movement of the female connector toward a side away from the male connector from a state where the female connector is connected to the male connector, the engaging portion of the female connector continuously engages with the engaged portion of the aligning plate until the aligning plate is away from the male connector together with the female connector.

The connector according to the present invention may be configured to include an engaging portion formed on the male connector, a projection formed on the engaged portion of the aligning plate, and the connector may be configured such that in mounting the female connector on the male connector by moving the female connector toward the male connector side, the engaging portion of the female connector is brought into contact with a locking portion of the male connector so that a state where the locked portion of the aligning plate is locked to the locking portion of the male connector is released, and the connector is also configured such that until releasing of the state where the locked portion of the aligning plate is locked to the locking portion of the male connector is finished, the projection of the engaged portion of the aligning plate is brought into contact with the engaging portion of the male connector thus preventing movement of the aligning plate toward a proximal end side of the male terminals.

The connector according to the present invention may be configured such that the aligning plate formed into a rectangular flat plate shape, the connector may be configured such that the aligning plate is positioned with respect to the male connector in a longitudinal direction which is one predetermined direction orthogonal to a moving direction of the female connector with respect to the male connector by making the engaged portion of the aligning plate engage with the engaging portion of the male connector, and the connector may be configured such that the aligning plate is positioned with respect to the male connector in a lateral direction which is a direction orthogonal to the moving direction of the female connector with respect to the male connector and the longitudinal direction due to at least one of locking between the locked portion of the aligning plate and the locking portion of the male connector and engagement between both ends of the aligning plate in the lateral direction and the locking portion of the male connector.

According to the present invention, the connector which includes the male connector, the female connector and the aligning plate can acquire the following advantageous effects. Even when a strong force (load) is applied to the connector in a temporarily locked state, there is no possibility that the aligning plate is moved toward the male connector. Further, it is possible to provide the connector where the aligning plate, once mounted, can be easily removed from the male connector.

DETAILED DESCRIPTION

An embodiment of the present invention is described in detail with reference to drawings.

In this specification, it must be noted that drawings are schematic views, and constitutions of devices and systems are different from constitutions of an actual device. Accordingly, the specific constitutions should be determined by taking into account the description made hereinafter. Further, it is also needless to say that the respective drawings include portions having different constitutions.

The embodiment of the present invention described hereinafter is provided for exemplifying a device and a method which embody the technical concept of the present invention, and the technical concept of the present invention does not limit materials, shapes, structures, arrangements and the like of the respective constitutional parts to the followings. Various modifications are conceivable with respect to the technical concept of the present invention within the technical scope described in claims.

Figure 1:
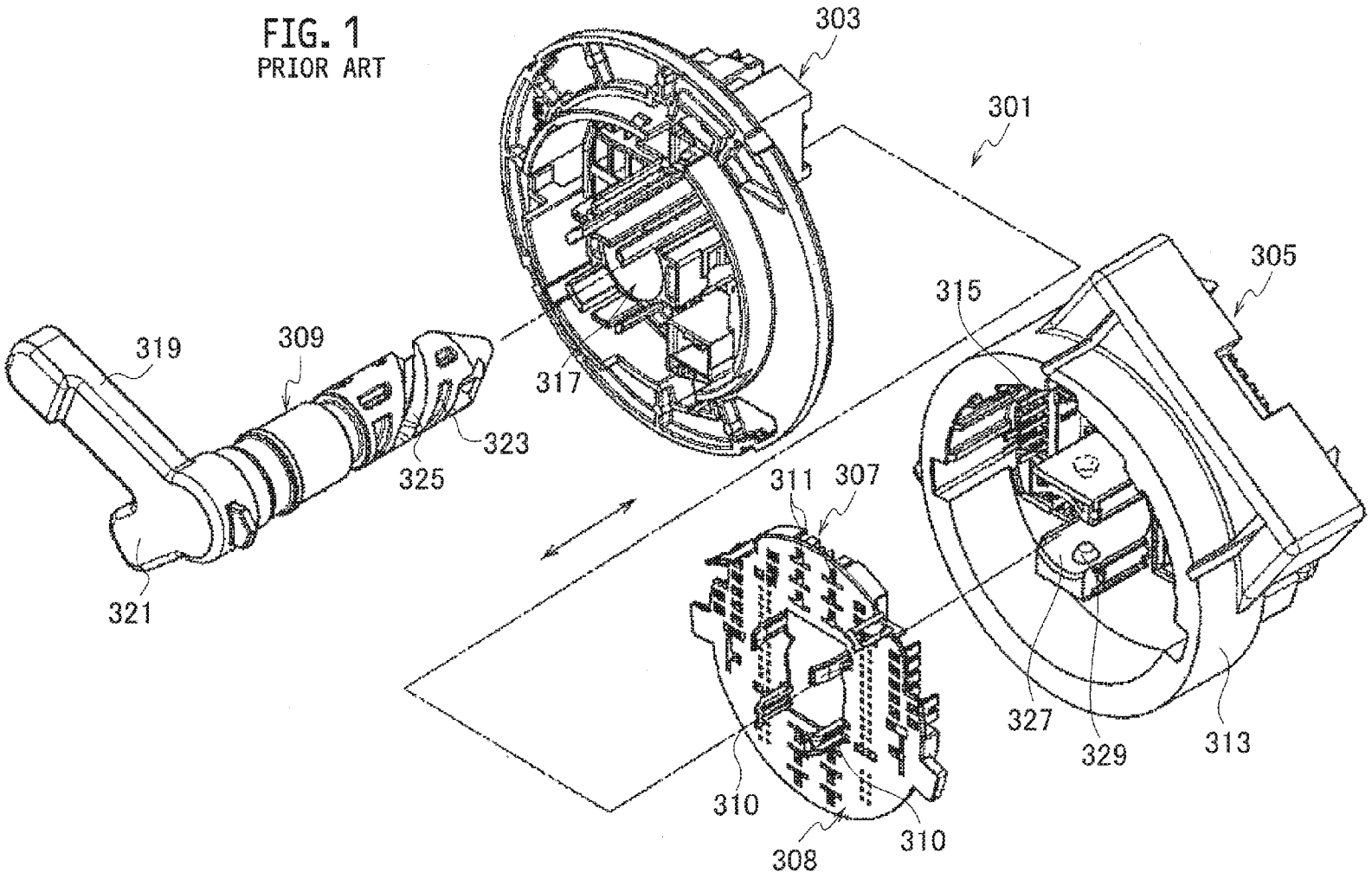
FIG. 1 PRIOR ART
FIG. 1 is a view showing a conventional connector.
Figure 2A:
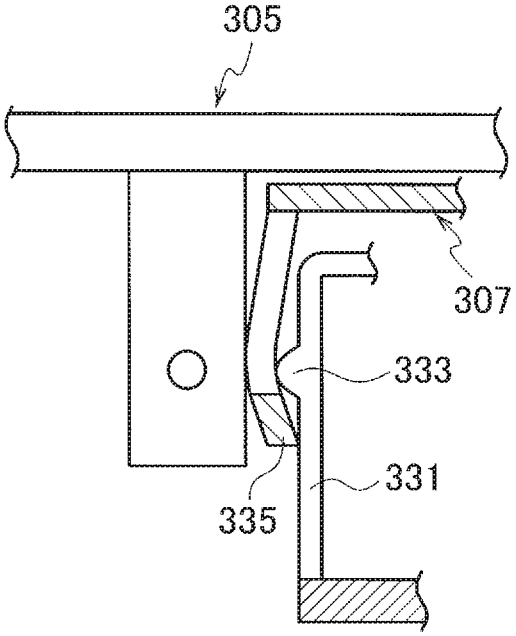
FIG. 2A PRIOR ART
FIG. 2A is a view showing a locking state of a moving plate and a female housing side of the conventional connector.
Figure 2B:
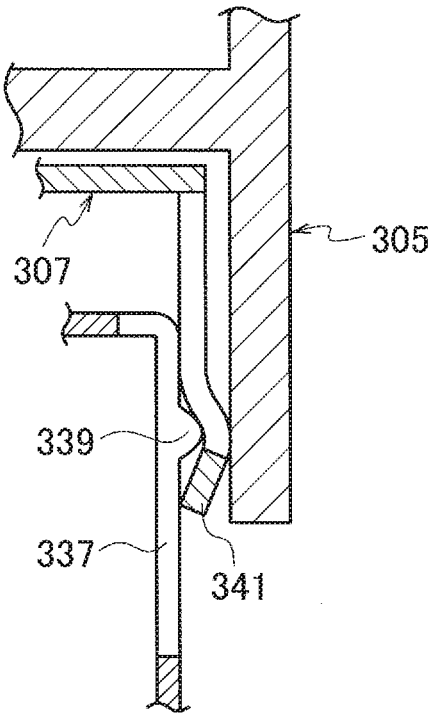
FIG. 2B PRIOR ART
FIG. 2B is a view showing a locking state of the moving plate and the female housing side of the conventional connector.
Figure 3:
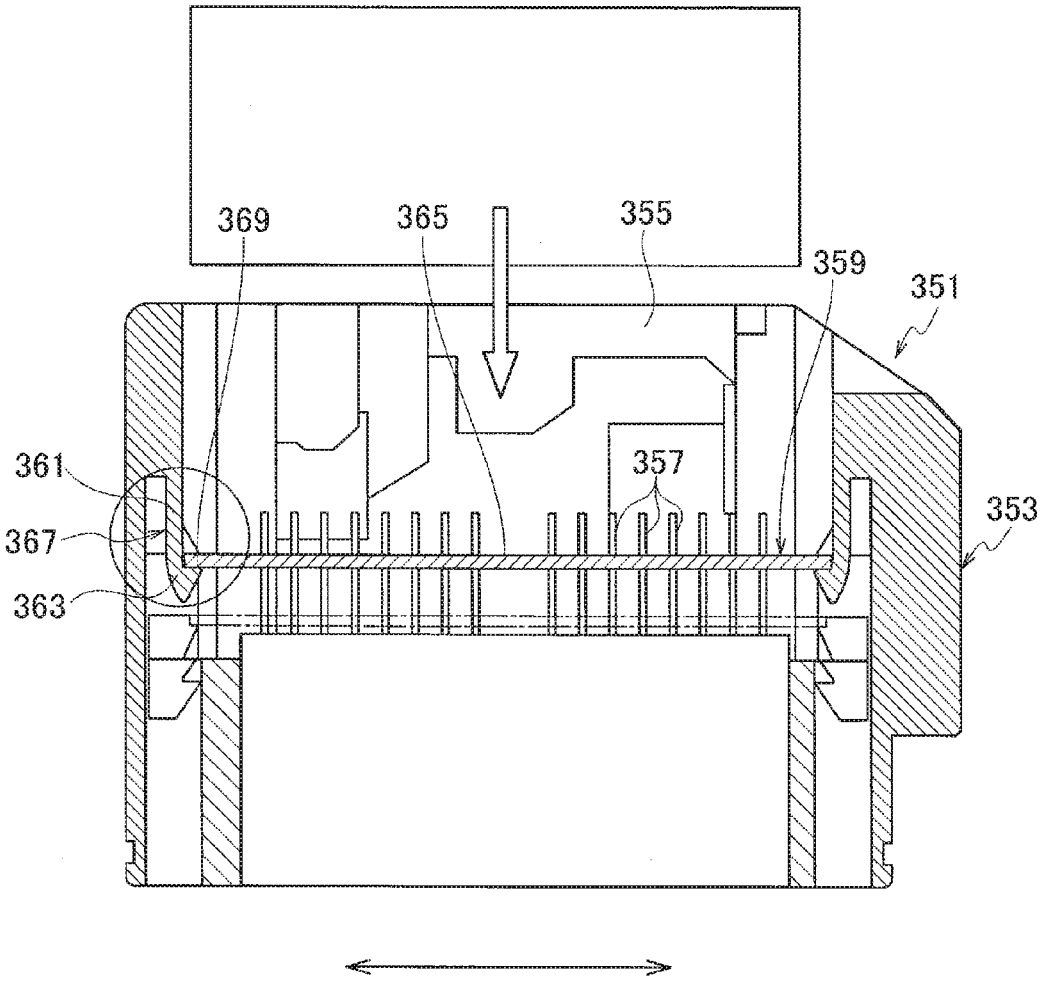
FIG. 3 PRIOR ART
FIG. 3 is a view showing the conventional connector.
Figure 4A:
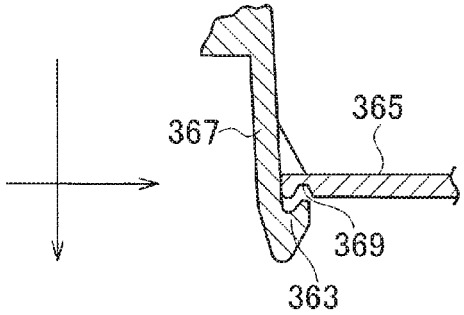
FIG. 4A PRIOR ART
FIG. 4A is a view showing a state before an aligning plate of the conventional connector is held on a temporarily locking hook.
Figure 4B:
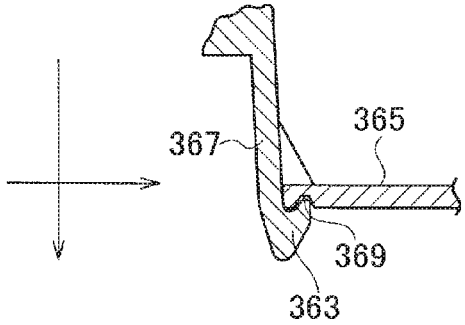
FIG. 4B PRIOR ART
FIG. 4B is a view showing a state where the aligning plate of the conventional connector is held on the temporarily locking hook.
Figure 4C:
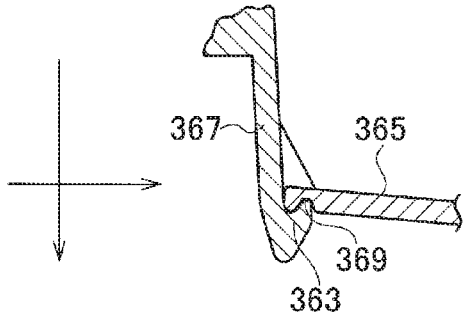
FIG. 4C PRIOR ART
FIG. 4C is a view showing a state where the aligning plate held on the temporarily locking hook of the conventional connector is pushed.
Figure 4D:
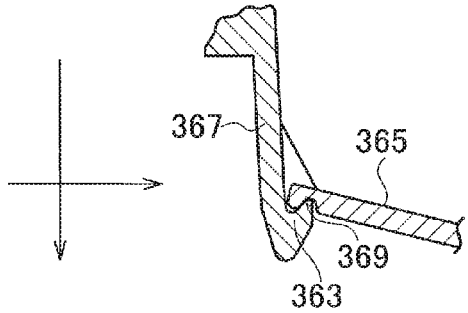
FIG. 4D PRIOR ART
FIG. 4D is a view showing a state where the aligning plate shown in FIG. 4C is pushed by a further large force.
Figure 5:
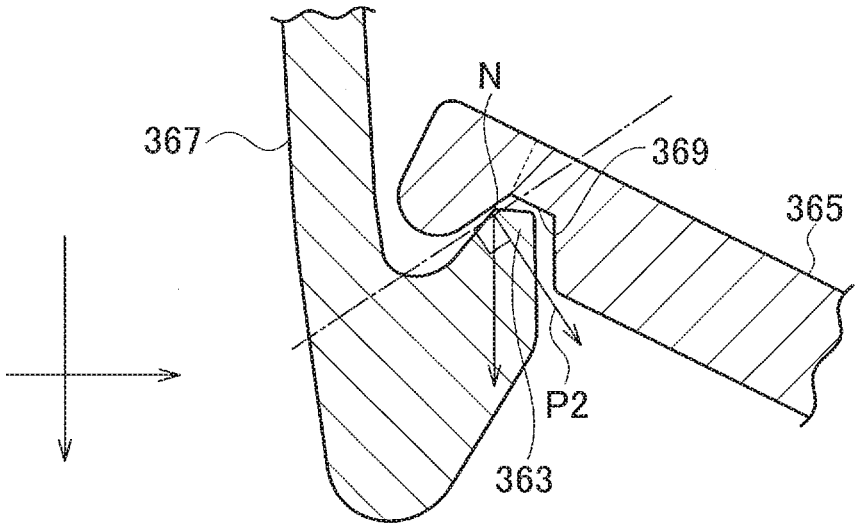
FIG. 5 PRIOR ART
FIG. 5 is a view showing the conventional connector.
Figure 6:
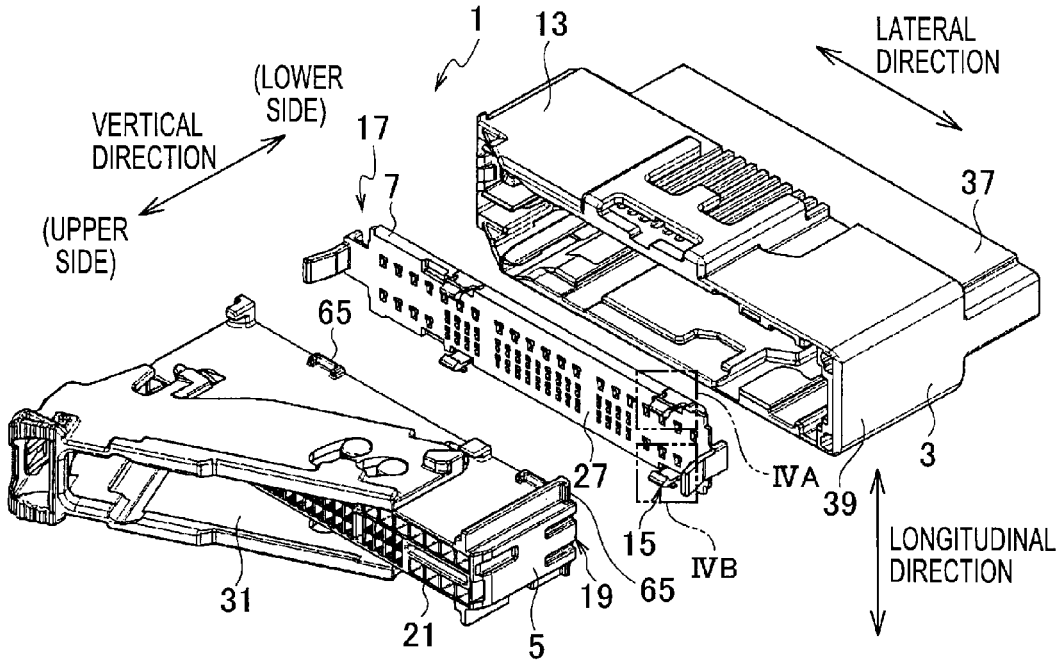
FIG. 6 is a perspective view of a connector according to an embodiment of the present invention, and is a view showing a state where a female connector and the aligning plate are removed from a male connector.

A connector 1 according to this embodiment, as shown in FIG. 6 and the like, includes a male connector 3, a female connector 5, and an aligning plate (moving plate) 7.

Hereinafter, for the sake of convenience of the description, there may be a case where predetermined three directions in a space are referred to as a longitudinal direction, a lateral direction and a vertical direction respectively. The longitudinal direction, the lateral direction and the vertical direction are orthogonal to each other.

Figure 7:
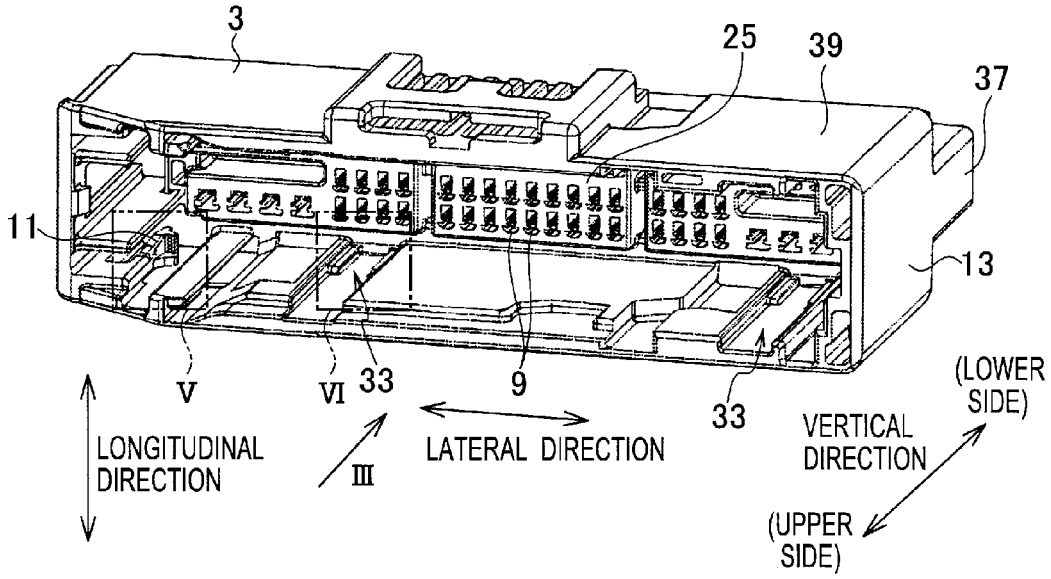
FIG. 7 is a perspective view of the male connector according to the embodiment of the present invention.
Figure 8:
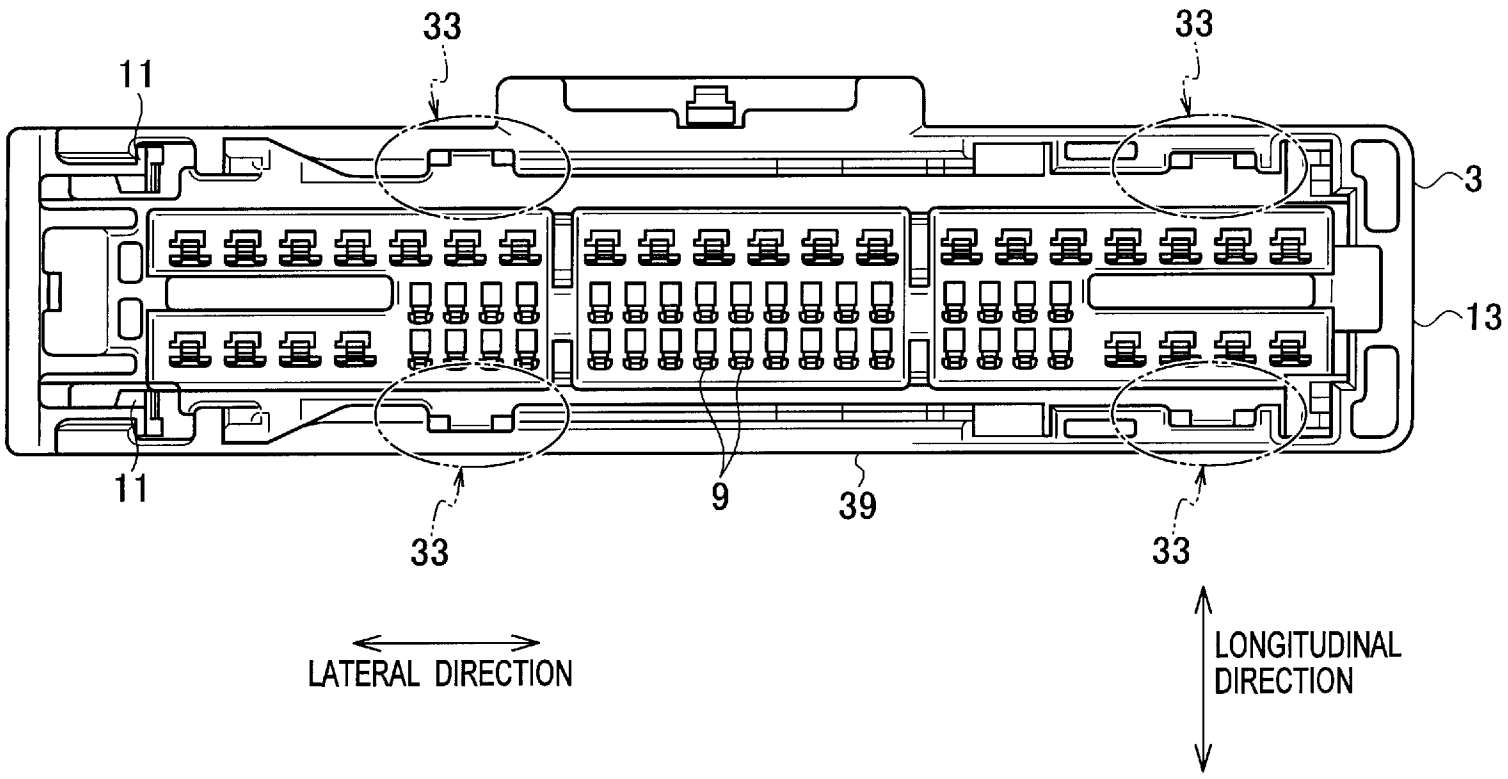
FIG. 8 is a cross-sectional view as viewed in the direction indicated by an arrow III in FIG. 7.

As shown in FIG. 7, FIG. 8 and the like, the male connector 3 includes terminal receiving chambers 9 in which a male terminal not shown in the drawings (male tub, male terminal fitting) is received respectively, and a locking portion (for example, a plate holding arm) 11. In the male connector 3, the male terminals are mounted in the male connector housings 13, and the locking portion 11 is formed of a portion of the male connector housing 13.

The male connector housing 13 is formed by integral molding using an electrically insulating material such as a synthetic resin, for example. Each male terminal is formed into an elongated rod shape. The male terminals are arranged at predetermined intervals in the direction (longitudinal direction or lateral direction) orthogonal to the longitudinal direction (vertical direction).

The aligning plate 7 is configured to engage with the male terminals so as to perform at least one of the protection of the male terminals and the correction of alignment of the male terminals (for example, the protection of the male terminals or the correction of alignment of the male terminals). The aligning plate 7 is configured to be movably engageable with the male connector 3 in a projecting direction of the male terminals (in the longitudinal direction; in the vertical direction in FIG. 14 and the like).

Figure 14:
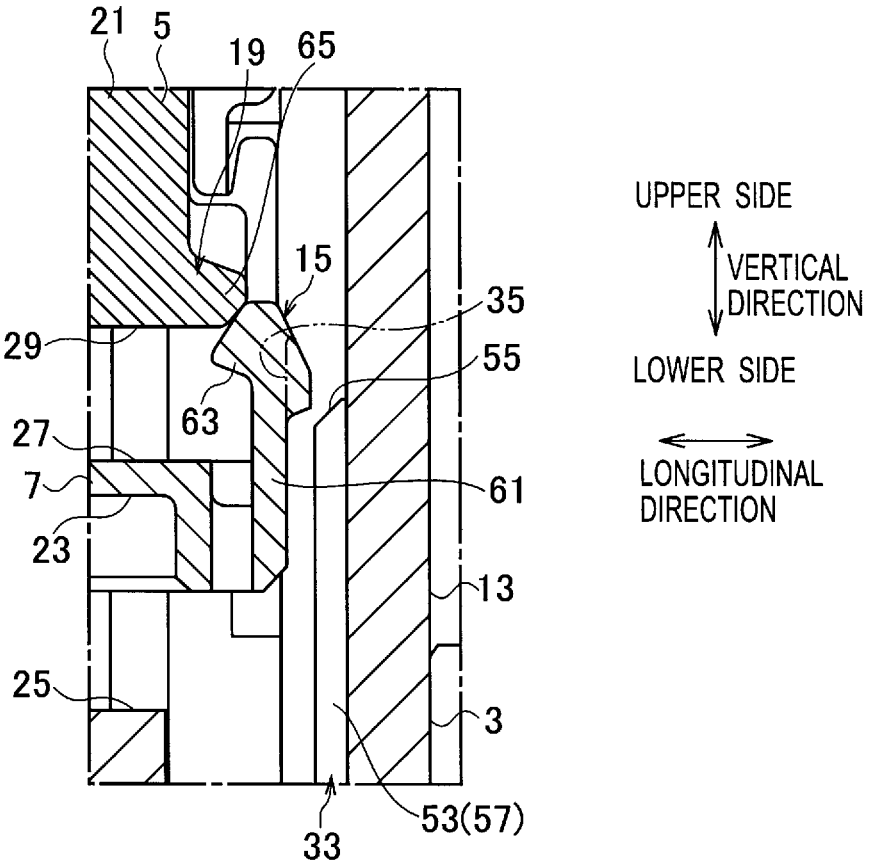
FIG. 14 is a view showing an engagement state of the engaging portion (deformation preventing rib) of the male connector, an engaging portion of the female connector, and an engaged portion of the aligning plate in a state shown in FIG. 13.
Figure 15:
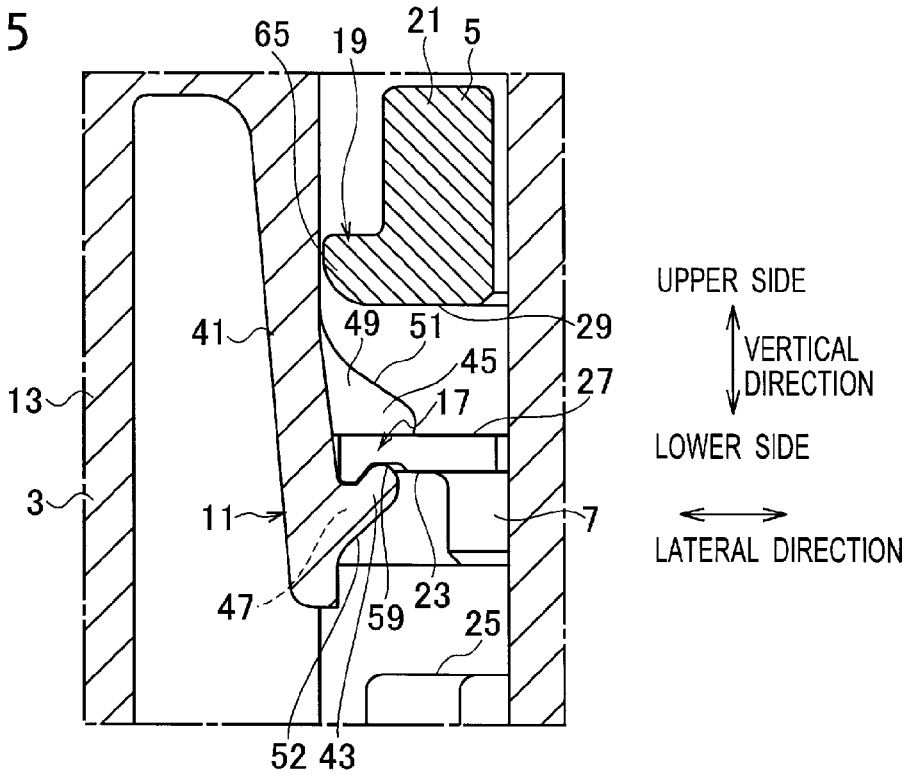
FIG. 15 is a view showing an engagement state of the engaging portion of the male connector, the engaging portion of the female connector, and a locked portion of the aligning plate in a state shown in FIG. 13.
Figure 16:
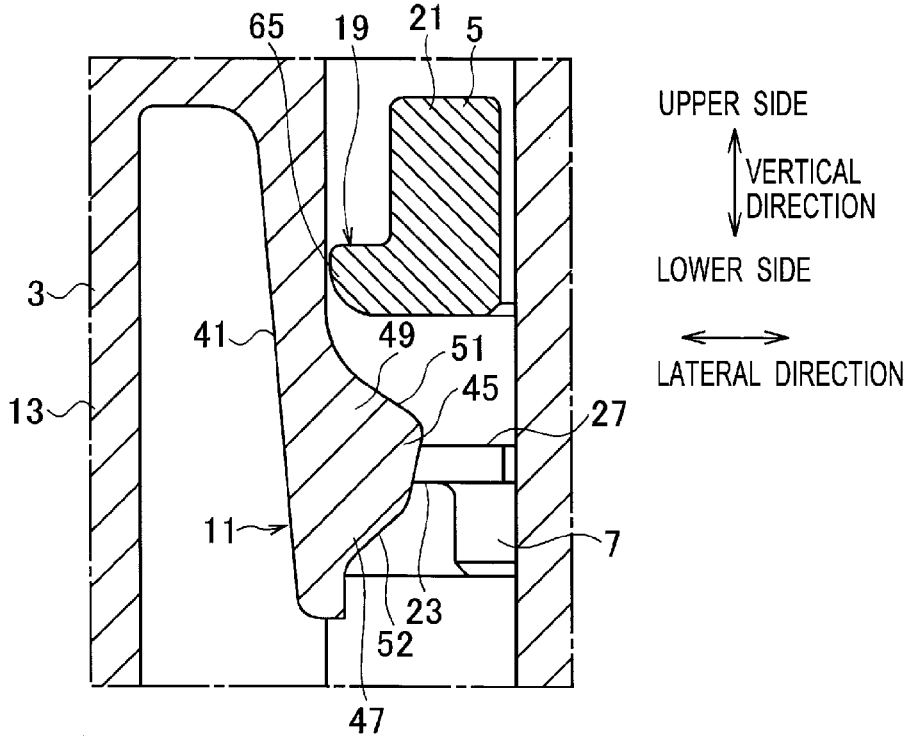
FIG. 16 is an enlarged view of a portion XI in FIG. 13.
Figure 17:
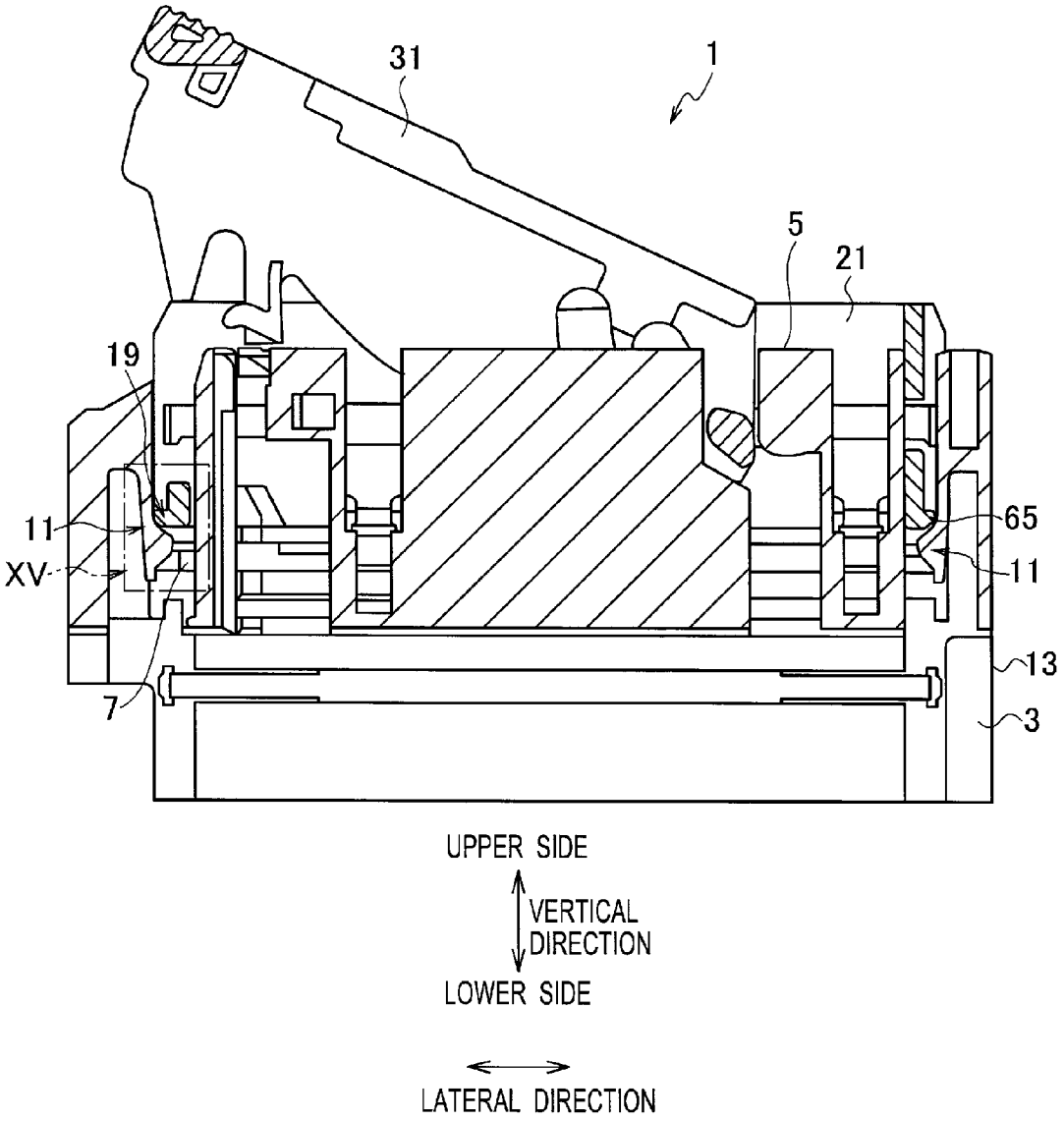
FIG. 17 is a view showing the manner of operation of the connector according to the embodiment of the present invention.

The aligning plate 7 is formed by integral molding using an electrically insulating material such as a synthetic resin. The aligning plate 7 includes, as shown in FIG. 14, FIG. 15 and the like, an engaged portion 15 and a locked portion 17. The locked portion 17 is formed on a surface (a lower surface) faced to a proximal end side of the male terminals, and are brought into contact with the locking portion 11 of the male connector 3.

In a state shown in FIG. 14 and FIG. 15 where the aligning plate 7 is temporarily mounted in the male connector 3, when the locked portion 17 is brought into contact with the locking portion 11 of the male connector 3, the aligning plate 7 is locked to the locking portion 11 of the male connector 3 so that the aligning plate 7 is supported on the male connector 3 from below thus preventing the movement of the aligning plate 7 toward the proximal end side of the male terminals (downward in FIG. 15).

In a state where the aligning plate 7 is temporarily mounted in the male connector 3, the aligning plate 7 is located at a predetermined position on an intermediate portion of the male terminals in the longitudinal direction of the male terminals.

The female connector 5 is configured to be integrally mounted on the male connector 3 together with the aligning plate 7 by being moved toward a male connector 3 side (a lower side: a proximal end side of the male terminal) in the longitudinal direction (vertical direction) of the male terminal (see FIG. 25 to FIG. 28).

As shown in FIG. 14 and the like, the female connector 5 is configured to include engaging portions 19 each of which engages with the engaged portion 15 of the aligning plate 7.

Figure 30:
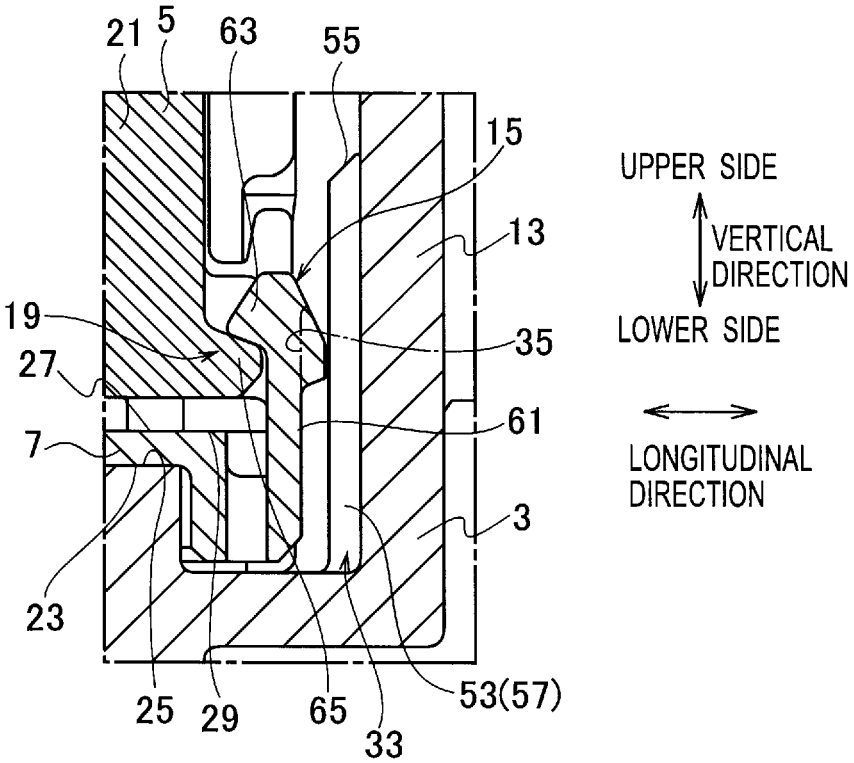
FIG. 30 is a view showing an engagement state of the engaging portion (deformation preventing rib) of the male connector, the engaging portion of the female connector, and the engaged portion of the aligning plate in a state shown in FIG. 29.
Figure 31:
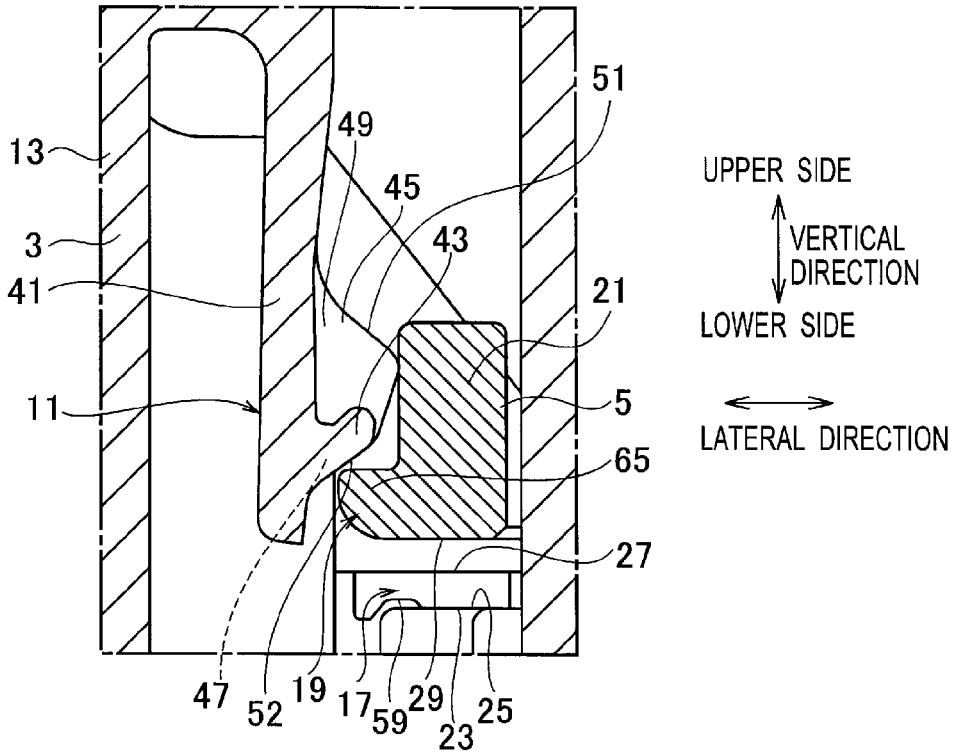
FIG. 31 is a view showing an engagement state of the engaging portion of the male connector, the engaging portion of the female connector, and the locked portion of the aligning plate in a state shown in FIG. 29.
Figure 32:
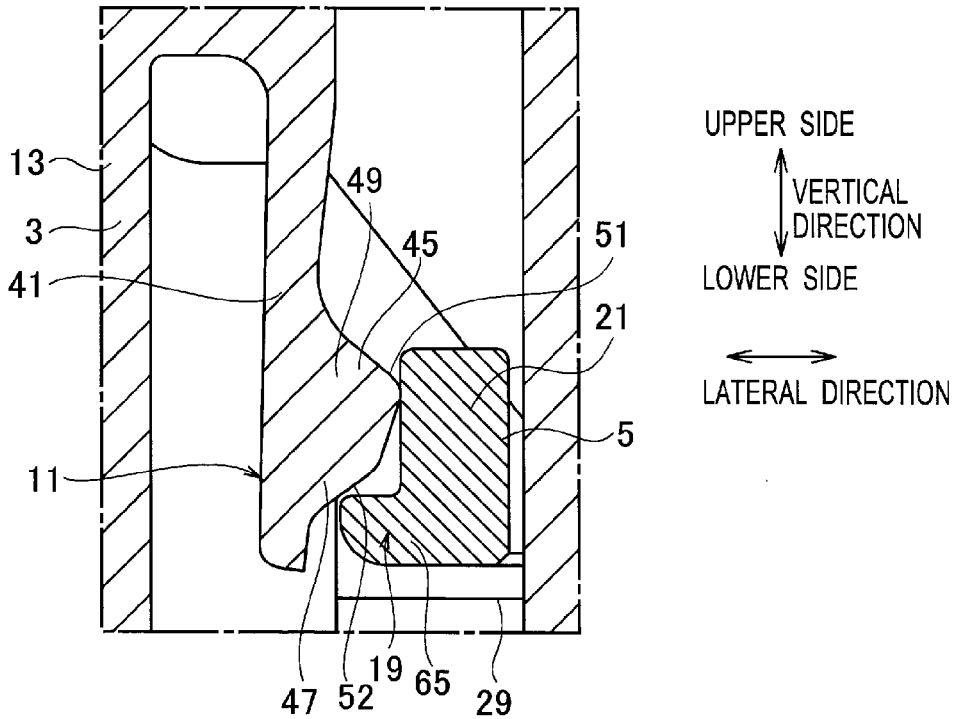
FIG. 32 is an enlarged view of a portion XXVII in FIG. 29.
Figure 33:
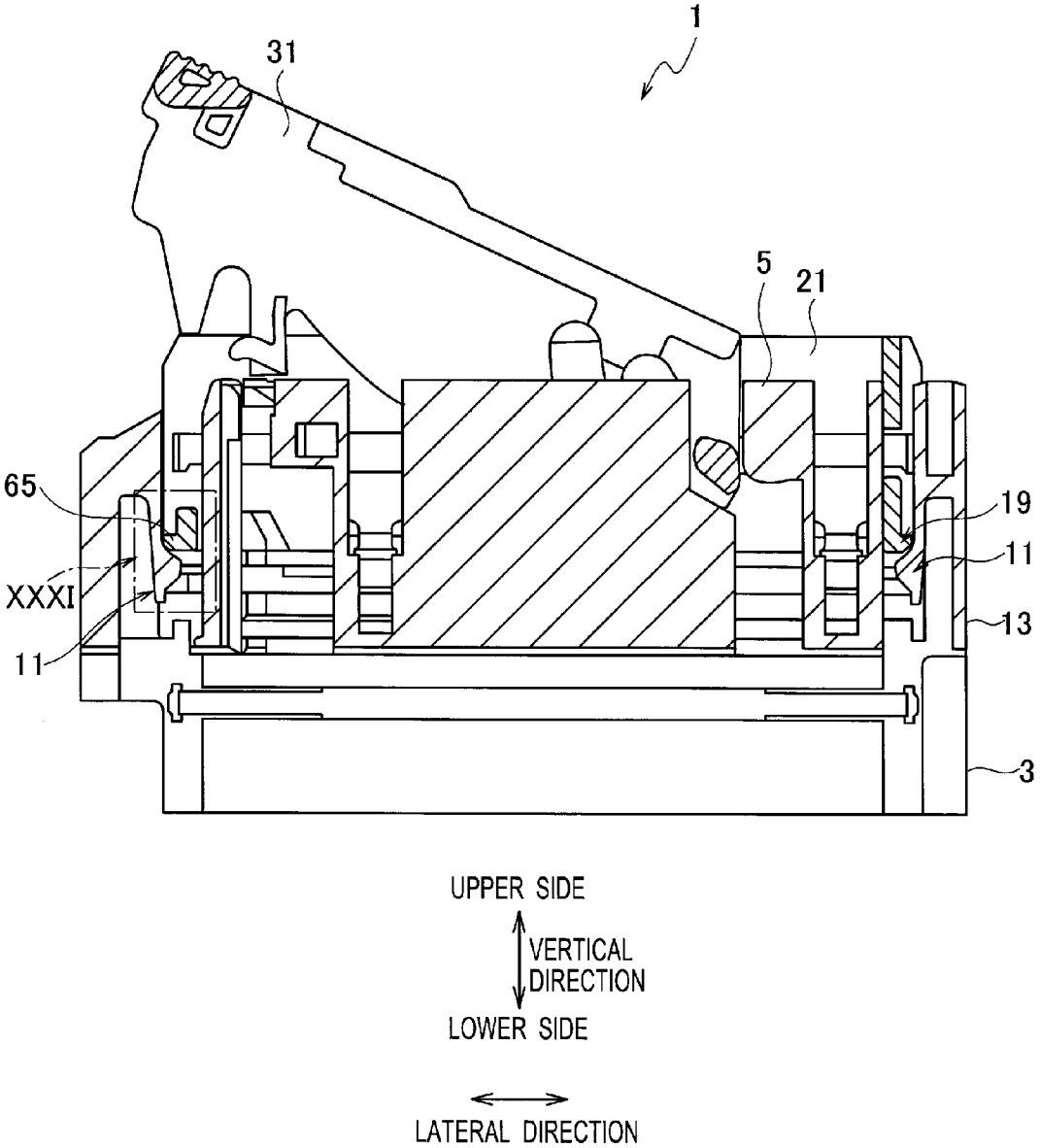
FIG. 33 is a view showing the manner of operation of the connector according to the embodiment of the present invention.

The female connector 5 is configured such that in removing the female connector 5 from the male connector 3 by moving of the female connector 5 toward a side away from the male connector 3 (toward an upper side) from a state where the female connector 5 is mounted in (connected to) the male connector 3, the engaging portion 19 engages with the engaged portion 15 of the aligning plate 7 (see FIG. 30 and the like). Then, the aligning plate 7 is also moved toward a side away from the male connector 3 (toward an upper side) together with the female connector 5 in a state where the aligning plate 7 is attached to the female connector 5.

The female connector 5 includes female terminals (not shown in the drawing) which are connected to the male terminals. In the female connector 5, the female terminals (female terminal fittings) are mounted on a female connector housing 21, and the engaging portion 19 is formed of a portion of the female connector housing 21. The female connector housing 21 is, for example, formed by integral molding using an electrically insulating material such as a synthetic resin.

Figure 23:
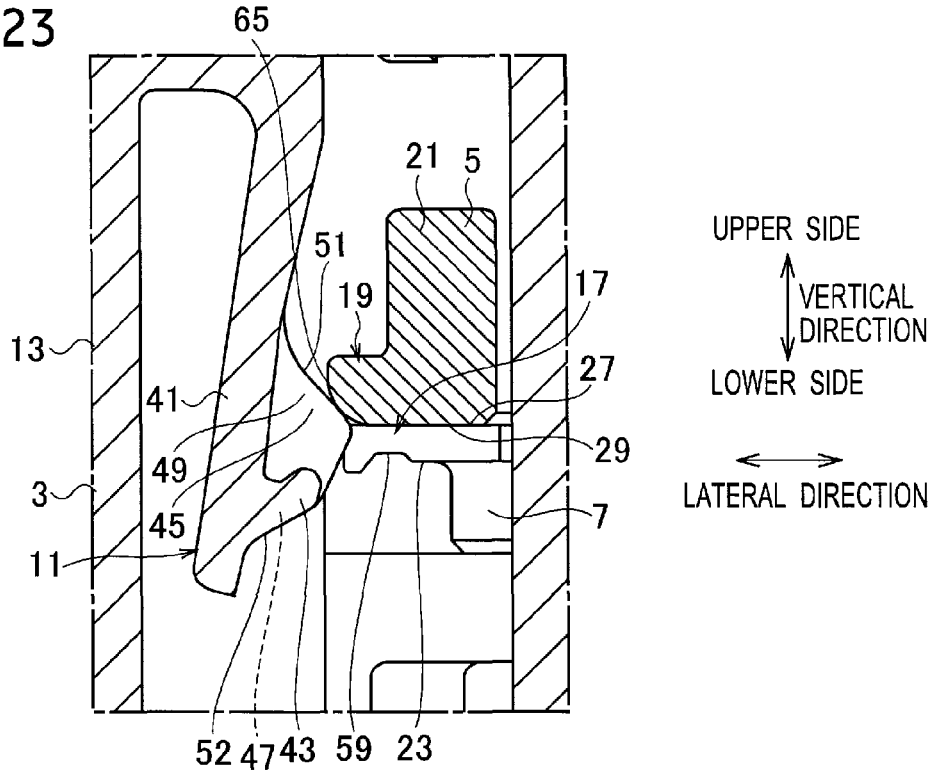
FIG. 23 is a view showing an engagement state of the engaging portion of the male connector, the engaging portion of the female connector, and the locked portion of the aligning plate in a state shown in FIG. 21.

The female terminals are connected to the male terminals by moving the female connector 5 toward the male connector 3 (a lower side). In moving the female connector 5 toward the male connector 3 (a lower side), a state where the aligning plate 7 is temporarily mounted on the male connector 3 (a state shown in FIG. 13 to FIG. 16) is released (the locking portion 11 of the male connector 3 being released from the locked portion 17 of the aligning plate 7 as shown in FIG. 23 and the like), and the aligning plate 7 is pushed toward the male connector 3 (a lower side) by the female connector 5 thus being moved together with the female connector 5.

In a state where the female connector 5 is connected to the male connector 3 (a state where mounting of the female connector 5 and the aligning plate 7 in the male connector 3 is finished as shown in FIG. 25 to FIG. 28), a lower surface 23 of the aligning plate 7 is brought into contact with an upper surface 25 which is a portion of the male connector housing 13 from which the male terminals project, an upper surface 27 of the aligning plate 7 is brought into contact with a lower surface 29 which is a portion of the female connector housing 21 where the female terminals are mounted and hence, the female connector 5, the aligning plate 7, and the male connector 3 are integrally formed with each other.

As shown in FIG. 6 and the like, a lever 31 is mounted on the connector 1. The lever 31 is provided for reducing a force necessary to mount the female connector 5 in the male connector 3 using principle of leverage.

That is, when a multipole housing (the male terminals of the male connector 3 and the female terminals of the female connector 5 being large in numbers) is used, a large force becomes necessary in connecting the respective female terminals to the respective male terminals simultaneously. However, with the use of the lever 31, a force necessary for connecting the respective female terminals to the respective male terminals can be reduced.

To be more specific, for example, the lever 31 has a proximal end portion thereof supported on the female connector 5 (the female connector housing 21), and is rotatable with respect to the female connector 5.

The lever 31 can reduce a force necessary for removing the female connector 5 from the male connector 3 using the principle of leverage in the same manner as the mounting of the female connector 5 in the male connector 3.

Figure 25:
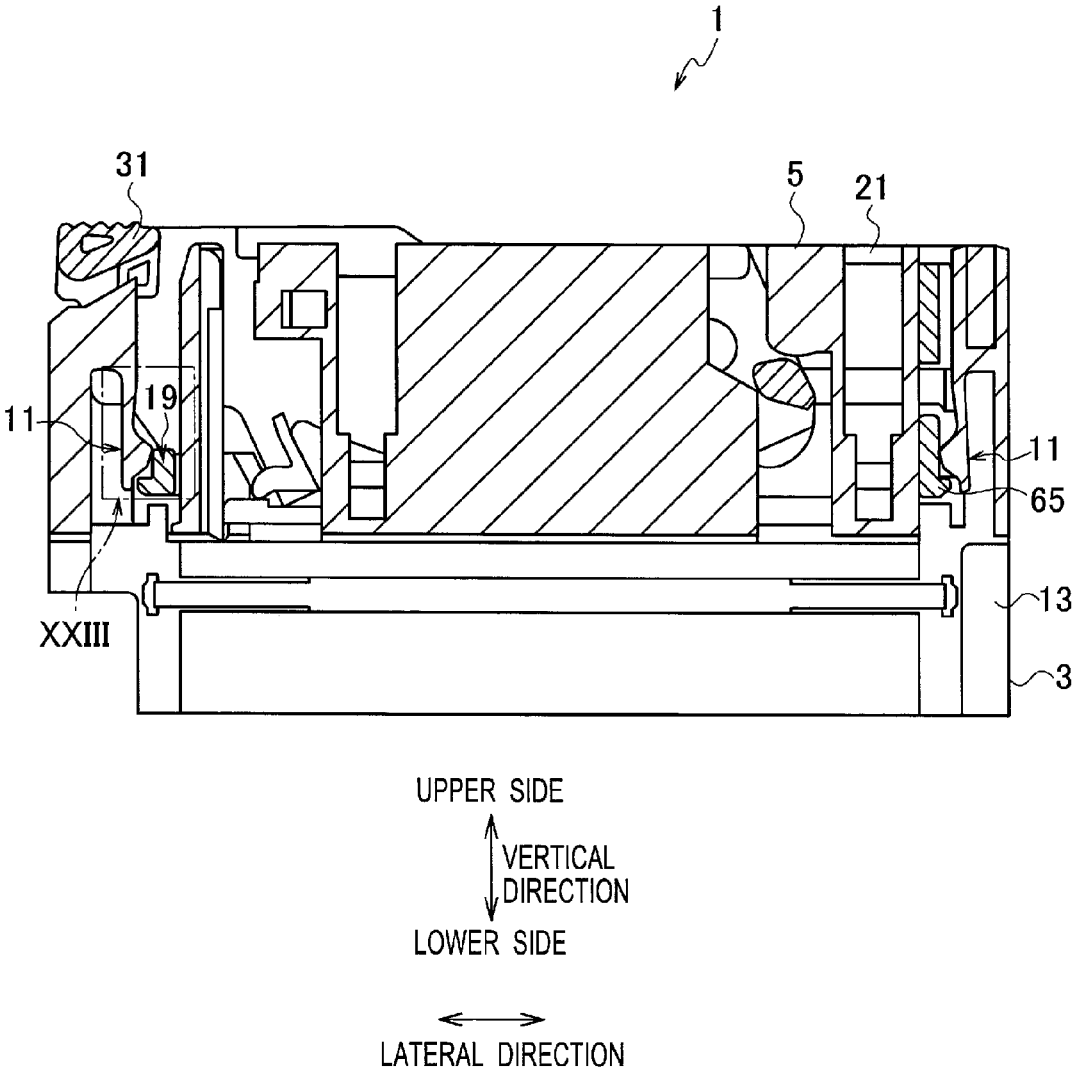
FIG. 25 is a view showing the manner of operation of the connector according to the embodiment of the present invention.
Figure 26:
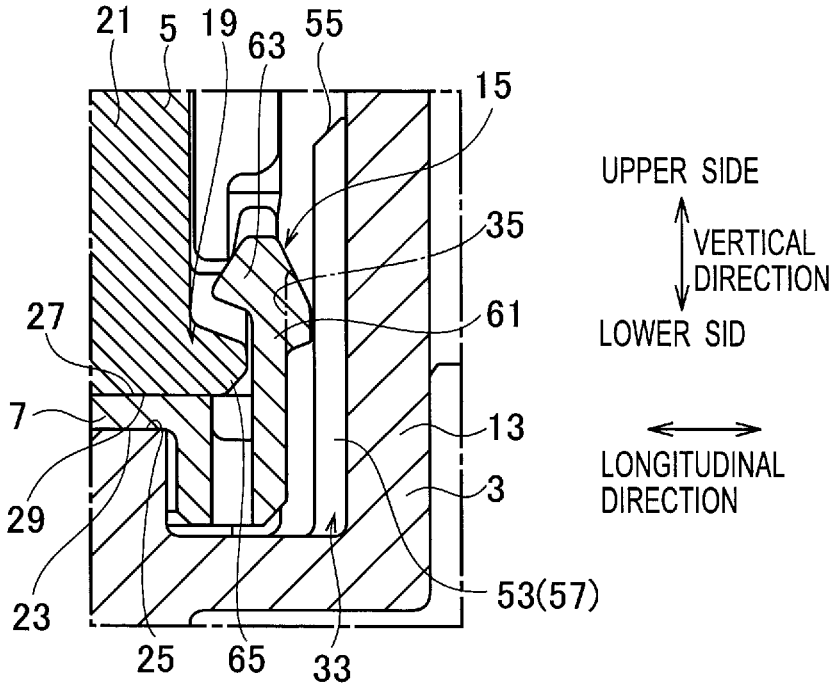
FIG. 26 is a view showing an engagement state of the engaging portion (deformation preventing rib) of the male connector, the engaging portion of the female connector, and the engaged portion of the aligning plate in a state shown in FIG. 25.

Further, the connector 1 is configured such that in the removal of the female connector 5 from the male connector 3 by moving the female connector 5 toward a side away from the male connector 3 from a state where the female connector 5 is connected to the male connector 3 as shown in FIG. 25 and the like, the engaging portion 19 of the female connector 5 continuously engages with the engaged portion 15 of the aligning plate 7 until the aligning plate 7 is separated from the male connector 3 together with the female connector 5 (until the female connector 5 is completely removed from the male connector 3 beyond the temporary mounted state).

Figure 9A:
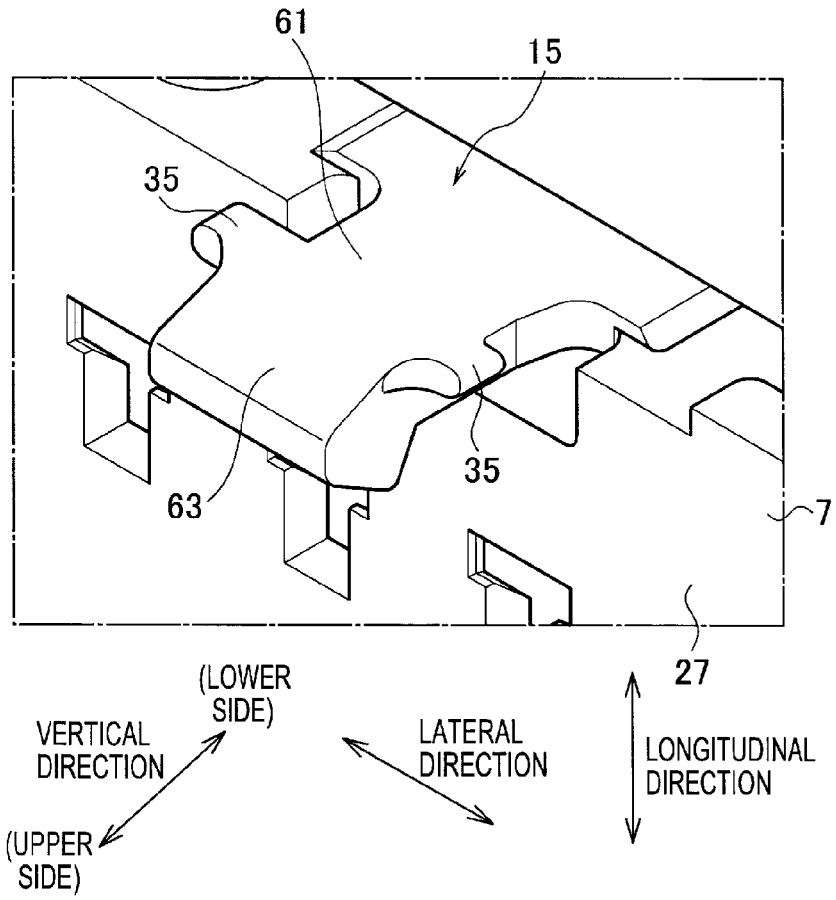
FIG. 9A is an enlarged view of a portion IVA in FIG. 6.
Figure 9B:
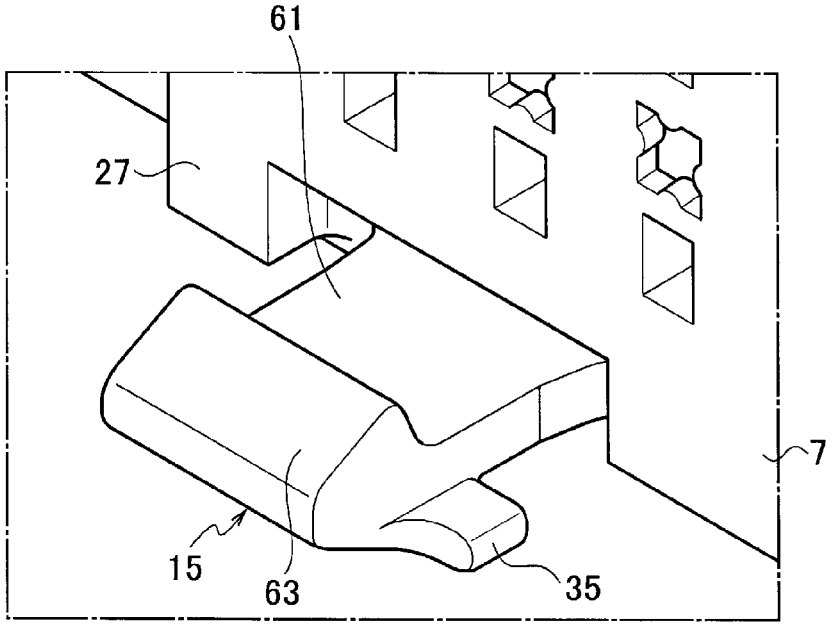
FIG. 9B is an enlarged view of the portion IVB in FIG. 6.
Figure 10:
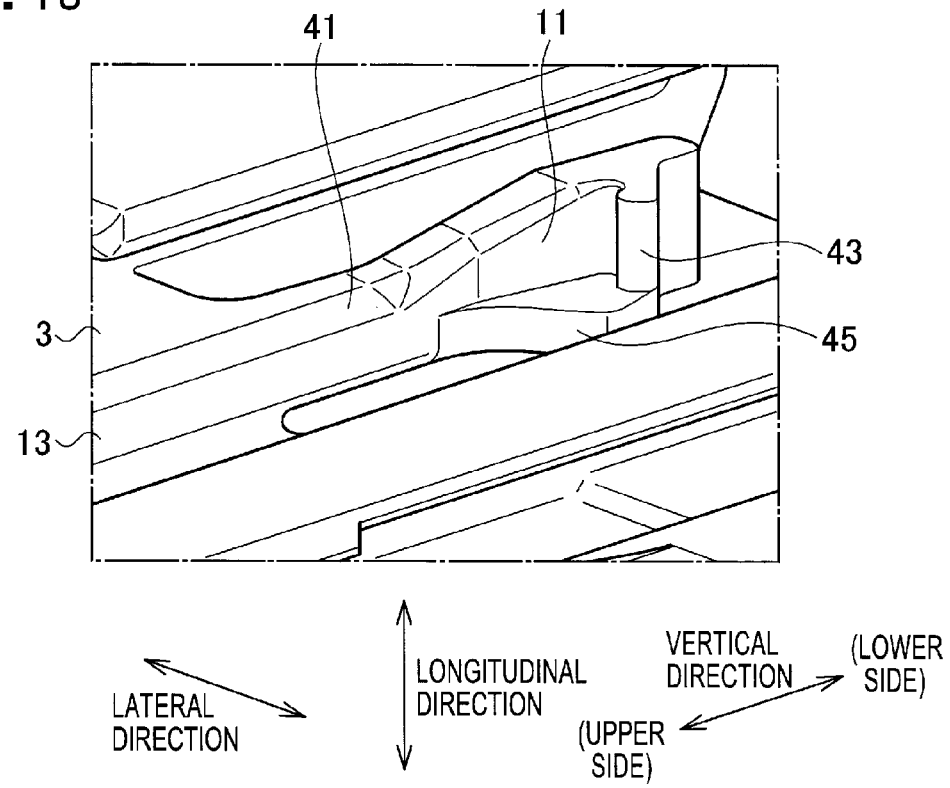
FIG. 10 is an enlarged view of a portion V in FIG. 7.
Figure 11:
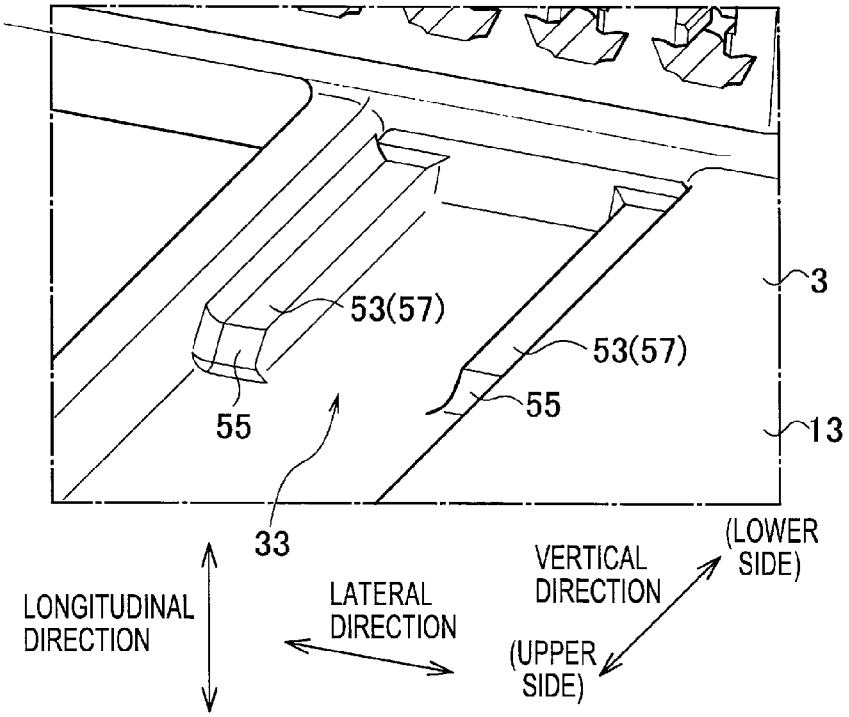
FIG. 11 is an enlarged view of a portion VI in FIG. 7.
Figure 12A:
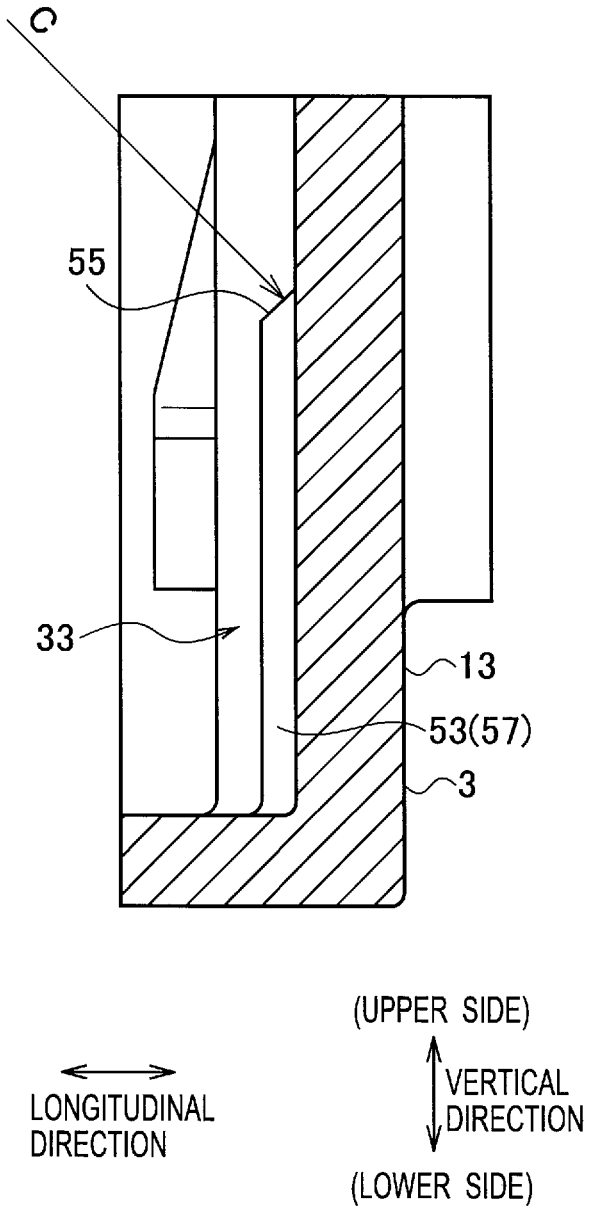
FIG. 12A is a view of a deformation preventing rib which constitutes an engaging portion of the male connector according to the embodiment of the present invention as viewed in a lateral direction.
Figure 12B:
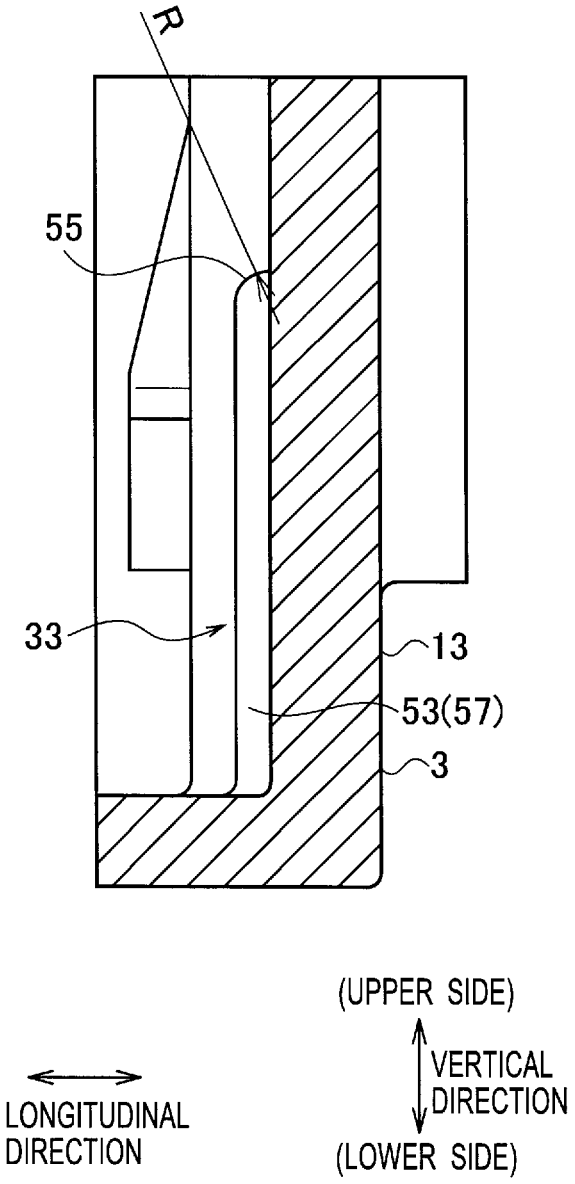
FIG. 12B is a view of the deformation preventing rib which constitutes the engaging portion of the male connector according to the embodiment of the present invention as viewed in a lateral direction.
Figure 13:
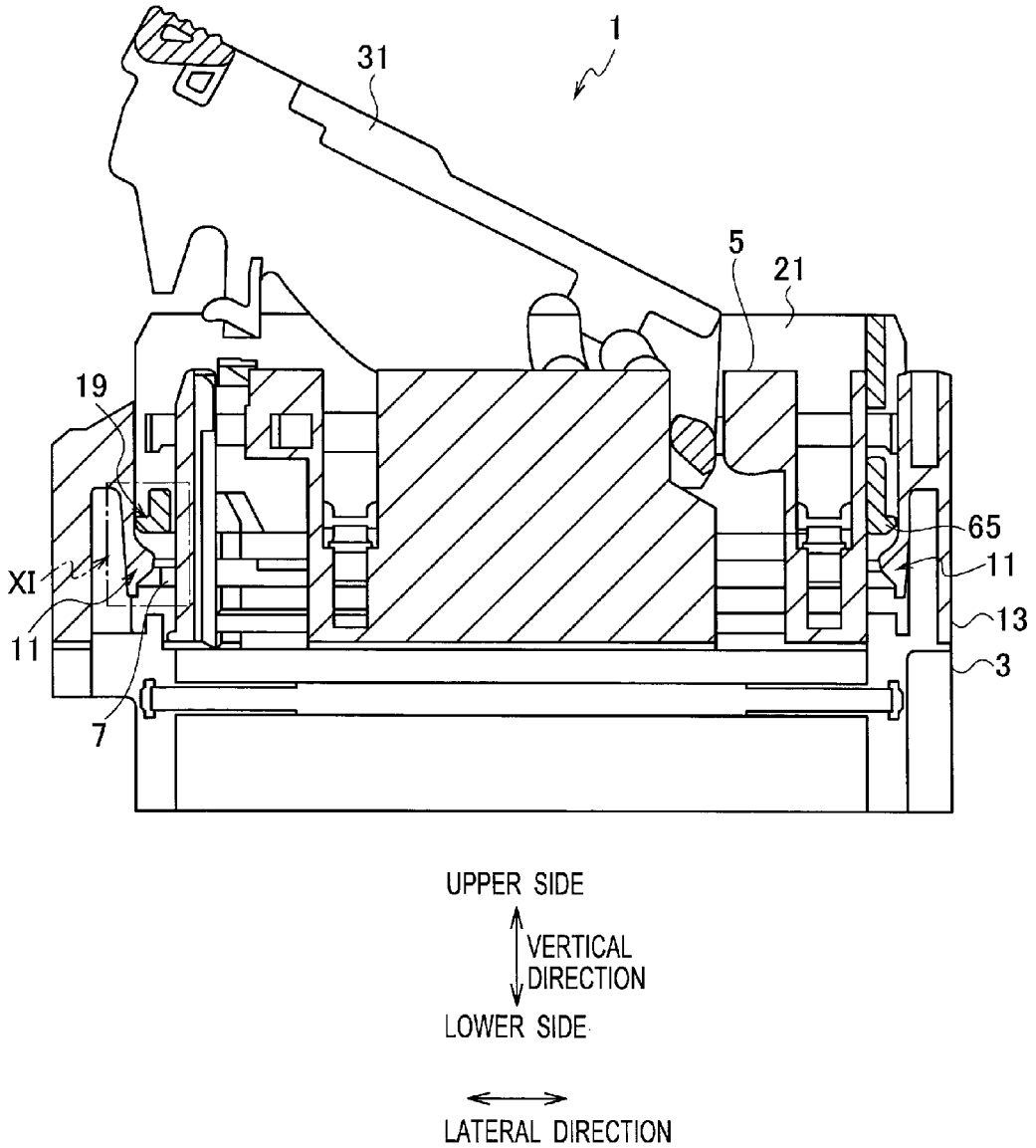
FIG. 13 is a view showing the manner of operation of the connector according to the embodiment of the present invention.

Further, an engaging portion (for example, a positioning taper) 33 shown in FIGS. 11 to 12B and the like is formed on the male connector 3, and a projection (a positioning projection) 35 shown in FIGS. 9A, 9B, and the like is formed on the engaged portion 15 of the aligning plate 7.

Figure 24:
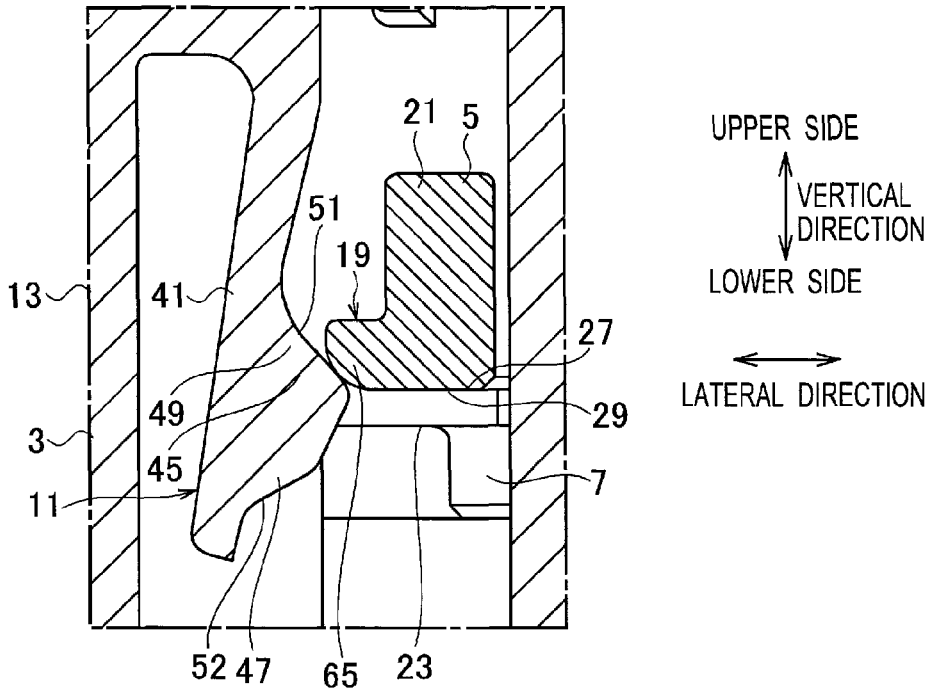
FIG. 24 is an enlarged view of a portion XIX in FIG. 21.

Further, the connector 1 is configured such that in mounting the female connector 5 in the male connector 3 by moving the female connector 5 toward the male connector 3 (a lower side), the engaging portion 19 of the female connector 5 is brought into contact with the locking portion 11 of the male connector 3 so that a state where the locked portion 17 of the aligning plate 7 is locked to the locking portion 11 of the male connector 3 (temporary mounted state) is released (see FIG. 23, FIG. 24 and the like). By releasing the temporary mounted state of the aligning plate 7, the aligning plate 7 moves downward together with the female connector 5.

The connector 1 may be configured such that in mounting the female connector 5 on the male connector 3 by moving the female connector 5 toward the male connector 3 (a lower side), until the release of the state where the locked portion 17 of the aligning plate 7 is locked to the locking portion 11 of the male connector 3 (temporary mounted state) is finished, the projection 35 of the engaged portion 15 of the aligning plate 7 is brought into contact with the engaging portion 33 (for example, an upper end portion of the engaging portion 33) of the male connector 3 (see FIG. 18) thus preventing the movement of the aligning plate 7 toward a proximal end side (a lower side) of the male terminals.

The aligning plate 7 is formed into a rectangular flat plate shape, and a plurality of through holes is formed in the aligning plate 7 in a penetrating manner in the thickness direction (vertical direction). Since the respective male terminals are inserted into the respective through holes, the aligning plate 7 engages with the male terminals.

Figure 18:
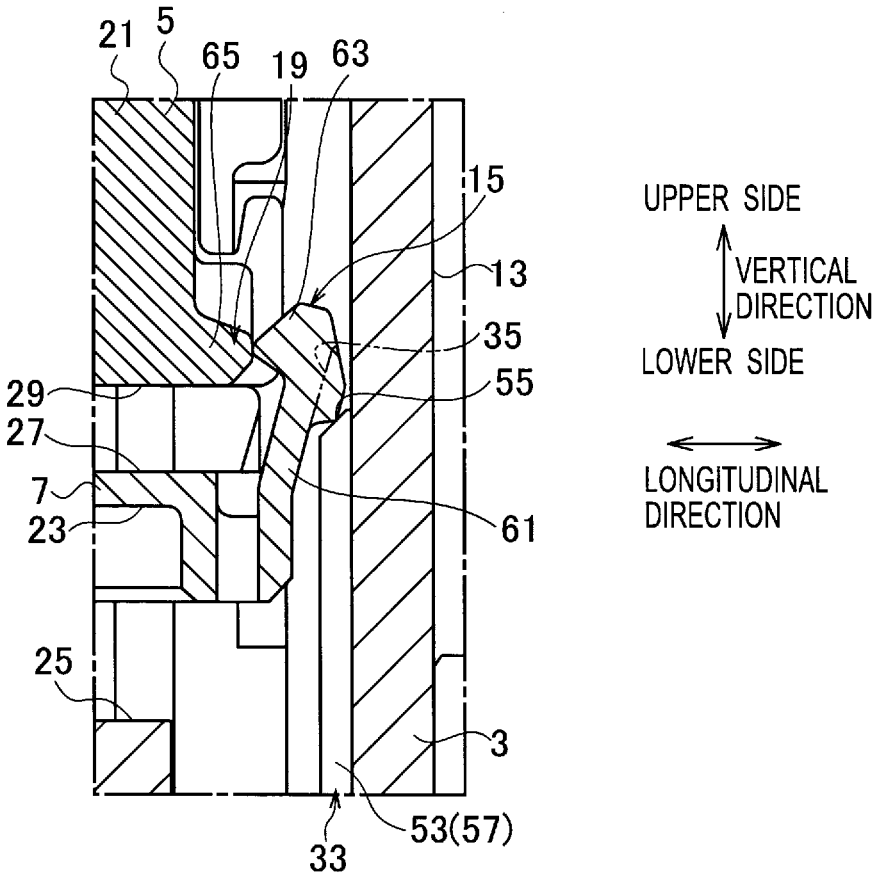
FIG. 18 is a view showing an engagement state of the engaging portion (deformation preventing rib) of the male connector, the engaging portion of the female connector, and the engaged portion of the aligning plate in a state shown in FIG. 17.
Figure 19:
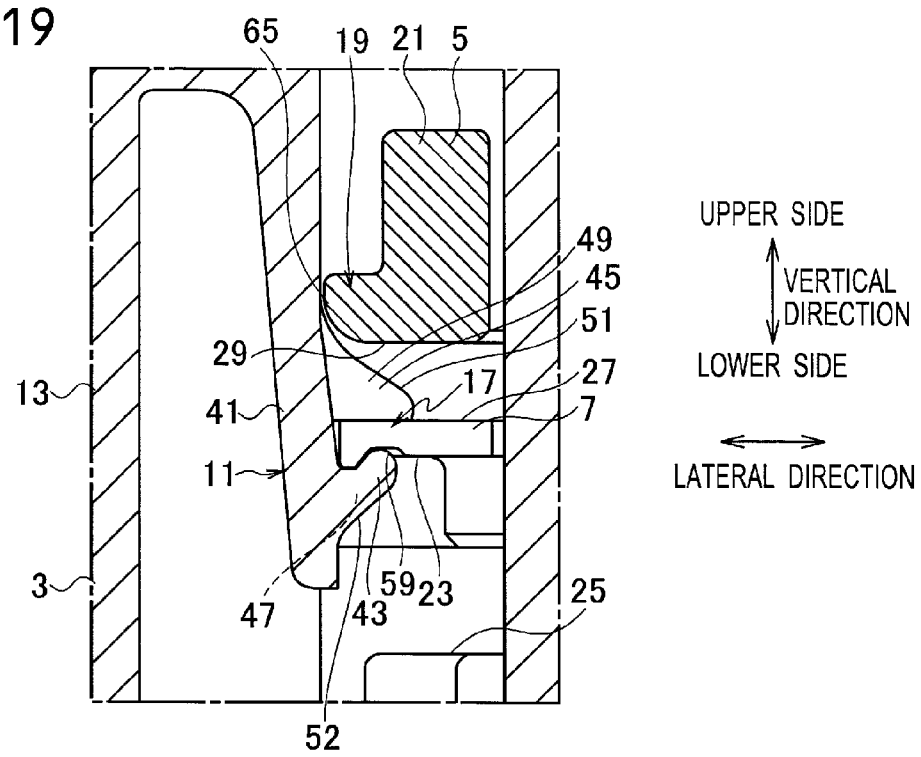
FIG. 19 is a view showing an engagement state of the engaging portion of the male connector, the engaging portion of the female connector, and the locked portion of the aligning plate in a state shown in FIG. 17.
Figure 20:
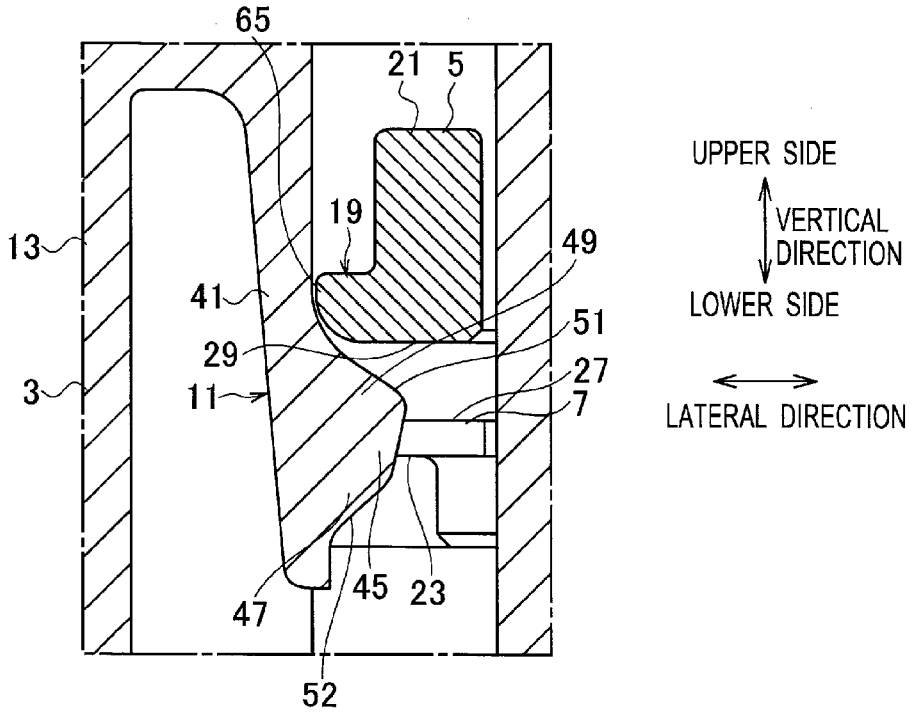
FIG. 20 is an enlarged view of a portion XV in FIG. 17.
Figure 21:
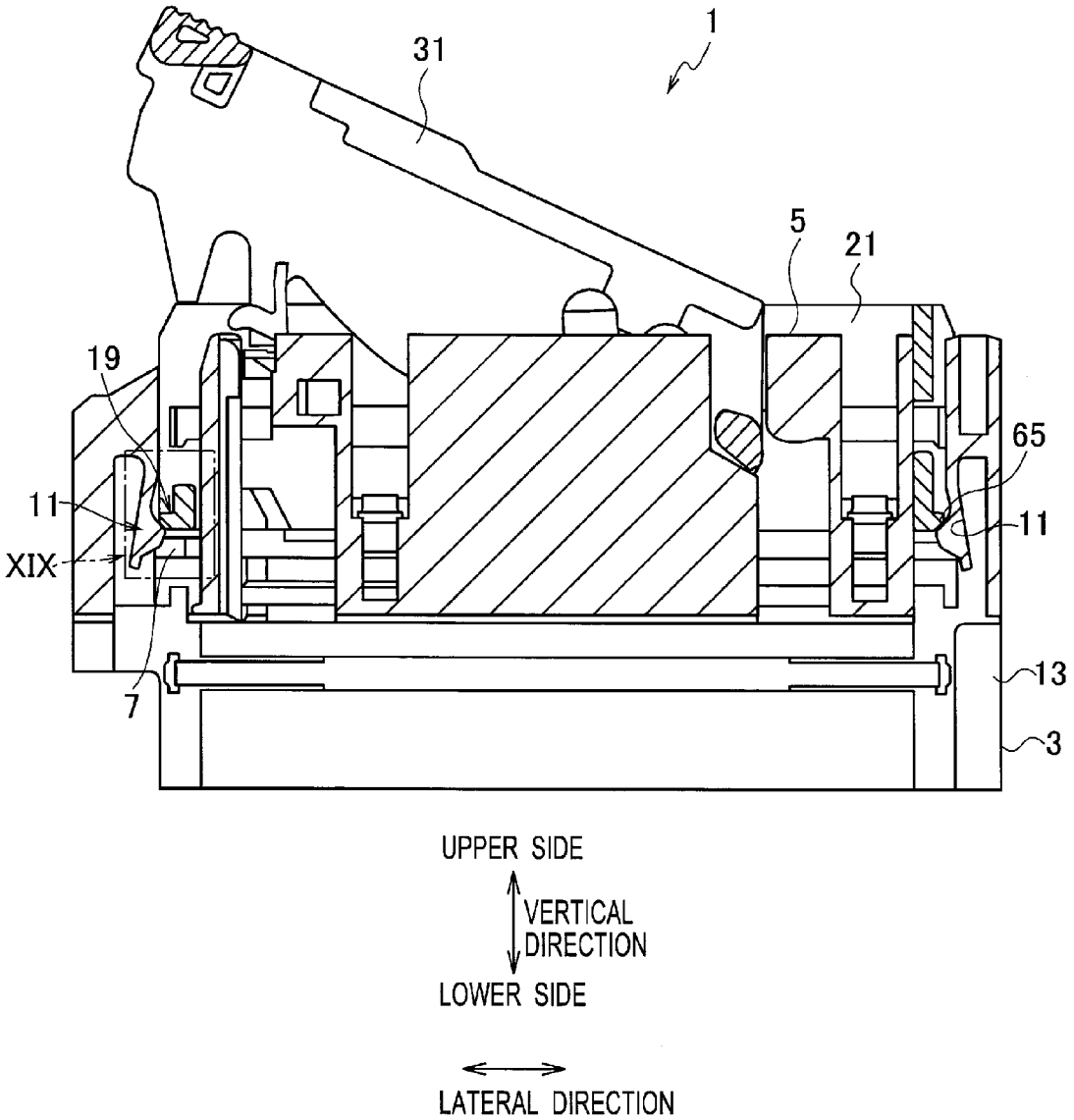
FIG. 21 is a view showing the manner of operation of the connector according to the embodiment of the present invention.

As shown in FIG. 18 and the like, the connector 1 is configured such that, by making the engaged portion 15 of the aligning plate 7 engage with the engaging portion 33 of the male connector 3, the aligning plate 7 is positioned with respect to the male connector 3 in a longitudinal direction which is one predetermined direction orthogonal to a moving direction (vertical direction) of the female connector 5 with respect to the male connector 3.

Further, as shown in FIG. 15 and the like, the connector 1 is configured such that, due to either one or both of the locking between the locked portion 17 of the aligning plate 7 and the locking portion 11 of the male connector 3 and the engagement between both ends of the aligning plate 7 in a lateral direction which is a direction orthogonal to the moving direction of the female connector 5 with respect to the male connector 3 and the longitudinal direction and the locking portion 11 of the male connector 3, the aligning plate 7 is positioned with respect to the male connector 3 in the lateral direction.

The connector 1 is described in more detail hereinafter.

As shown in FIG. 6 to FIG. 8 and the like, the male connector housing 13 includes a bottom portion (bottom wall portion) 37, and a hood portion (side wall portion) 39 which projects upward from the whole outer periphery of the bottom portion 37. The male terminals project upward from the upper surface 25 of the bottom portion 37 inside the hood portion 39.

The hood portion 39 is formed into a hollow square shape as viewed in the vertical direction, the respective male terminals are positioned inside the hood portion 39, and the respective male terminals are arranged at predetermined intervals in the longitudinal direction as well as in the lateral direction.

The locking portion 11 of the male connector 3 is constituted of an elastic arm 41 which extends toward the bottom portion 37 (downward) from an opening portion of an upper end of the hood portion 39 inside the hood portion 39, a pawl portion 43 which is formed on a distal end portion (a lower end portion) of the elastic arm 41, and a contact portion 45 which is formed on the distal end portion of the elastic arm 41. The distal end (a lower end) of the elastic arm 41 is spaced apart from the bottom portion 37, and is arranged in a cantilever manner.

For example, four elastic arms 41 are provided. Among these elastic arms 41, two elastic arms 41 are formed on the hood portion 39 positioned at one end in the lateral direction, and other two elastic arms 41 are formed on the hood portion 39 positioned at the other end in the lateral direction. Further, four elastic arms 41 are positioned in the vicinity of respective corner portions of the hood portion 39 having a rectangular shape respectively.

As shown in FIG. 15 and the like, the pawl portion 43 and the contact portion 45 project toward the center of the hood portion 39 in the lateral direction. Further, as shown in FIG. 8 and the like, the contact portion 45 is positioned outside the pawl portion 43 (a side opposite to a center side of the male connector housing 13) in the longitudinal direction.

A distal-end-side portion (a lower portion) of the elastic arm 41 is slightly bent toward the center of the male connector housing 13 in the lateral direction (see FIG. 15 and the like). With such a configuration, a distance (a lateral size) between the elastic arm 41 which is formed on the hood portion 39 positioned at one end in the lateral direction and the elastic arm 41 which is formed on the hood portion 39 positioned at the other end in the lateral direction is set to a fixed value at proximal-end-side portions (upper side portions) of the elastic arms 41. However, the distance is slightly but gradually decreased at distal-end-side portions of the elastic arms 41 as the elastic arms 41 extend downward.

As shown in FIG. 15 and the like, the pawl portion 43 projects from a portion of the elastic arm 41 in the vicinity of the distal end of the elastic arm 41 slightly upward (toward an opening portion side of the hood portion 39). The contact portion 45 is fixed to the pawl portion 43, and the contact portion 45 includes an overlapping portion 47 which overlaps with the pawl portion 43 as viewed in the longitudinal direction, and an upper portion 49 which projects upward from the overlapping portion 47 (see FIG. 15 and the like). An inclined locking-portion upper guide surface 51 is formed on an upper end side of the upper portion 49. Further, an inclined locking-portion lower guide surface 52 is formed also on lower end sides of the pawl portion 43 and the contact portion 45.

The engaging portion 33 of the male connector 3 is formed of a rib (deformation preventing rib) 53 which projects inward from an inner surface of the hood portion 39 and extends toward the opening portion (upward) from the bottom portion 37. An upper end of the rib 53 forms an inclined engaging portion guide surface 55. As shown in FIG. 12A, the engaging portion guide surface 55 is formed into a planar inclined surface such as a surface indicated by C. However, as shown in FIG. 12B, the engaging portion guide surface 55 may be formed into an arc-shaped surface indicated by R.

As can be understood from FIG. 7 and the like, four sets of ribs 53 are provided. Among these four sets of ribs 53, two sets of ribs 53 are formed on the hood portion 39 which is positioned at one end in the lateral direction, and other two sets of ribs 53 are formed on the hood portions 39 which are positioned at the other end in the lateral direction. The respective four sets of ribs 53 are positioned in the vicinity of respective corner portions of the hood portion 39 having a rectangular shape.

As shown in FIG. 11 and the like, one set of ribs 53 is constituted of a pair of rails 57. As has been already described with reference to FIGS. 12A and 12B, the rail 57 is formed into an elongated rectangular columnar shape having an upper surface thereof inclined. The pair of rails 57 is arranged in a slightly spaced apart manner in the lateral direction.

A size in the longitudinal direction of the aligning plate 7 which is formed into a rectangular flat plate shape is set smaller than a size between a pair of wall portions positioned on both ends of the hood portion 39 of the male connector 3 in the longitudinal direction. A size of the aligning plate 7 in the lateral direction is set smaller than a size between the pair of wall portions positioned on both ends of the hood portion 39 of the male connector 3 in the lateral direction.

The aligning plate 7 is mounted in the male connector 3 such that a thickness direction of the aligning plate 7 is directed in the vertical direction, the longitudinal direction of the aligning plate 7 agrees with the longitudinal direction of the hood portion 39 (the male connector 3), and the lateral direction of the aligning plate 7 agrees with the lateral direction of the hood portion 39.

As shown in FIG. 15 and the like, the locked portion 17 of the aligning plate 7 is constituted of a recessed portion 59 which is formed on a lower surface (a surface on the proximal end side of the male terminals) of the aligning plate 7. The recessed portion 59 formed on the locked portion 17 of the aligning plate 7 is formed in the vicinity of both ends of the aligning plate 7 in the lateral direction.

As shown in FIGS. 9A, 9B, and the like, the engaged portion 15 of the aligning plate 7 is constituted of an elastic arm 61 which projects toward one side (an upper side) in the thickness direction of the aligning plate 7 from a predetermined portion of the outer peripheral portion of the aligning plate 7, a pawl portion (for example, a plate lifting lock) 63 which is formed on a distal end portion of the elastic arm 61, and the projection (positioning projection) 35 which is formed on the distal end portion of the elastic arm 61.

With respect to the elastic arm 61 of the engaged portion 15 of the aligning plate 7, four elastic arms 61 are provided, for example. Among these elastic arms 61, two elastic arms 61 project upward from one end of the aligning plate 7 in the longitudinal direction, and other two elastic arms 61 project upward from the other end of the aligning plate 7 in the longitudinal direction. The respective four elastic arms 61 are positioned in the vicinity of respective corner portions of the rectangular aligning plate 7 in the same manner as the four sets of ribs 53.

In a state where the aligning plate 7 is mounted in the male connector 3, the respective elastic arms 61 are arranged at positions corresponding to the respective ribs 53. To be more specific, the elastic arm 61 is positioned between the pair of rails 57.

The pawl portion 63 of the engaged portion 15 of the aligning plate 7 projects toward both sides in the longitudinal direction (toward the center and an outer side of the aligning plate 7) from the elastic arm 61 (see FIG. 14 and the like). The projections 35 of the engaged portion 15 of the aligning plate 7 project toward both sides in the lateral direction from portions where the pawl portion 63 projects outward (see FIGS. 9A, 9B, 14, and the like).

In a state where the aligning plate 7 is mounted in the male connector 3, the pawl portion 63 is positioned between the pair of rails 57. However, the projections 35 are arranged at positions where the projections 35 respectively engage with the pair of rails 57 (substantially at the same positions in the longitudinal direction).

The engaging portion 19 of the female connector 5 is constituted of projecting portions 65 which project from predetermined portions of the female connector 5. The projecting portions 65 project outward from both ends in the longitudinal direction as well as in the lateral direction on a lower end portion of the female connector housing 21 which is formed into a rectangular parallelepiped shape.

In the connector 1, the female connector 5 and the aligning plate 7 are mounted in the male connector 3 through the following operations.

In an initial state, as shown in FIG. 13 to FIG. 16, the aligning plate 7 is temporarily mounted in the male connector 3, and the female connector 5 is separated from the male connector 3 and the aligning plate 7.

In a state where the aligning plate 7 is temporarily mounted in the male connector 3, the aligning plate 7 engages with intermediate portions of the male terminals in the longitudinal direction of the male terminals, and the pawl portions 43 of the locking portions 11 of the male connector 3 are inserted into the recessed portions 59 of the locked portion 17 of the aligning plate 7 so that the aligning plate 7 is locked to the male connector 3.

Further, in the state where the aligning plate 7 is temporarily mounted in the male connector 3, the aligning plate 7 is positioned with respect to the male connector 3 in the lateral direction, the elastic arms 61 of the engaged portion 15 of the aligning plate 7 project upward, and the projections 35 of the engaged portion 15 and the pawl portions 63 of the aligning plate 7 are positioned above upper ends of the ribs 53 of the male connector 3.

Further, in a state where the aligning plate 7 is temporarily mounted, the aligning plate 7 is positioned in the inside of the contact portion 45 of the locking portion 11 of the male connector 3 in the longitudinal direction.

When mounting of the female connector 5 in the male connector 3 starts in a state where the aligning plate 7 is temporarily mounted in the male connector 3, the female connector 5 is positioned above the engaged portion 15 of the aligning plate 7.

In mounting the female connector 5 in the male connector 3 by downwardly pushing (by downwardly rotating) the lever 31, the female connector 5 moves downward from the above-described state where the aligning plate 7 is temporarily mounted in the female connector 5 and mounting of the female connector 5 in the male connector 3 starts.

Due to the downward movement of the female connector 5, firstly, the projecting portion 65 of the engaging portion 19 of the female connector 5 is brought into contact with the pawl portion 63 of the engaged portion 15 of the aligning plate 7, the elastic arm 61 of the engaged portion 15 of the aligning plate 7 is deflected outward, and the projection 35 of the engaged portion 15 of the aligning plate 7 is brought into contact with the inclined surface (the engaging portion guide surface; positioning taper) 55 which is formed on an upper surface of the rib 53 of the engaging portion 33 of the male connector 3 so that the aligning plate 7 is positioned with respect to the male connector 3 in the longitudinal direction (see FIG. 18 and the like).

Figure 22:
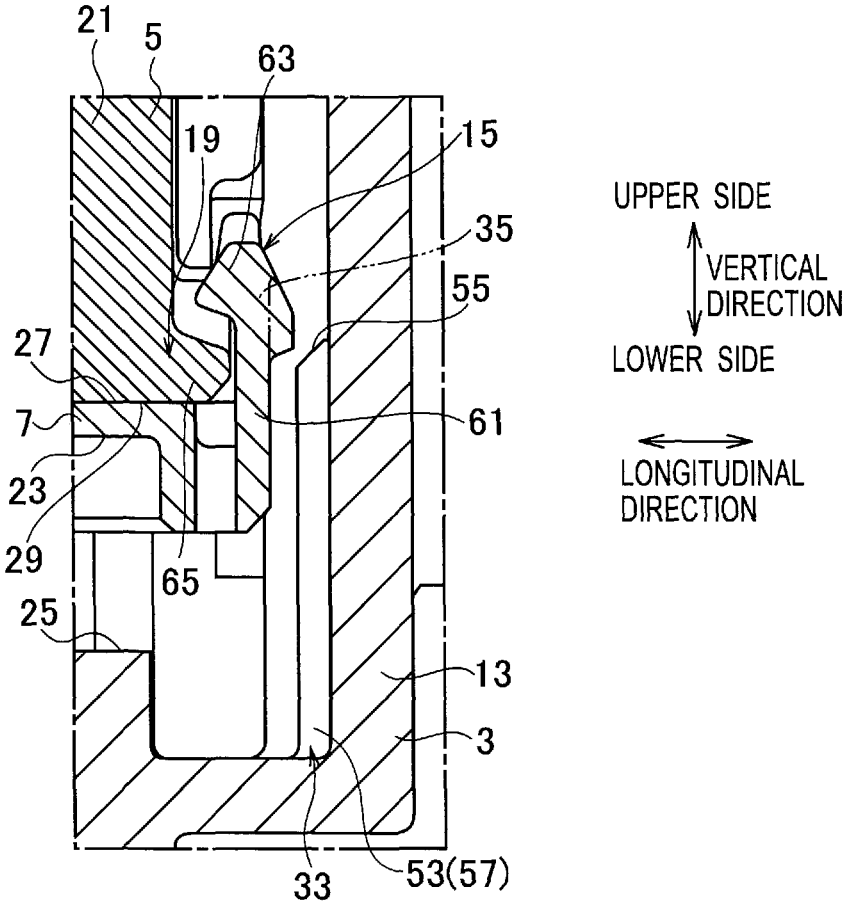
FIG. 22 is a view showing an engagement state of the engaging portion (deformation preventing rib) of the male connector, the engaging portion of the female connector, and the engaged portion of the aligning plate in a state shown in FIG. 21.

Subsequently, due to the further downward movement of the female connector 5, the projecting portion 65 of the engaging portion 19 of the female connector 5 comes over the pawl portion 63 of the engaged portion 15 of the aligning plate 7 so that the elastic arm 61 of the engaged portion 15 of the aligning plate 7 is restored, and is positioned below the pawl portion 63 of the engaged portion 15 of the aligning plate 7 (see FIG. 22).

Then, due to the further downward movement of the female connector 5, the projecting portion 65 of the engaging portion 19 of the female connector 5 is brought into contact with the contact portion 45 of the locking portion 11 of the male connector 3, and the elastic arm 41 of the locking portion 11 of the male connector 3 is deflected outward so that the locking portion 11 of the male connector 3 is removed from the locked portion 17 of the aligning plate 7 (see FIG. 23, FIG. 24).

Figure 27:
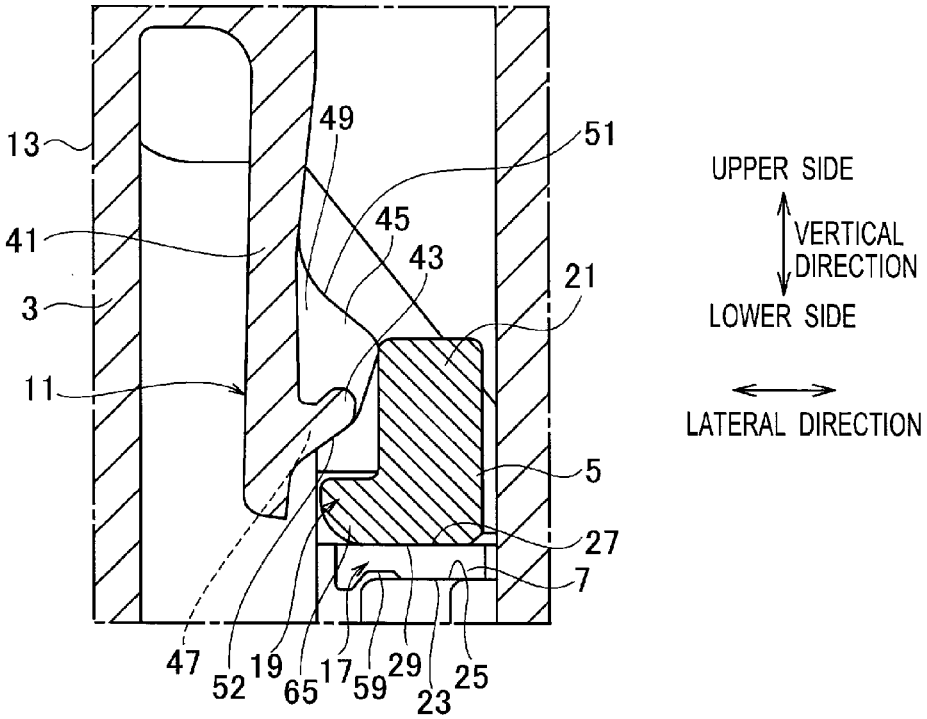
FIG. 27 is a view showing an engagement state of the engaging portion of the male connector, the engaging portion of the female connector, and the locked portion of the aligning plate in a state shown in FIG. 25.
Figure 28:
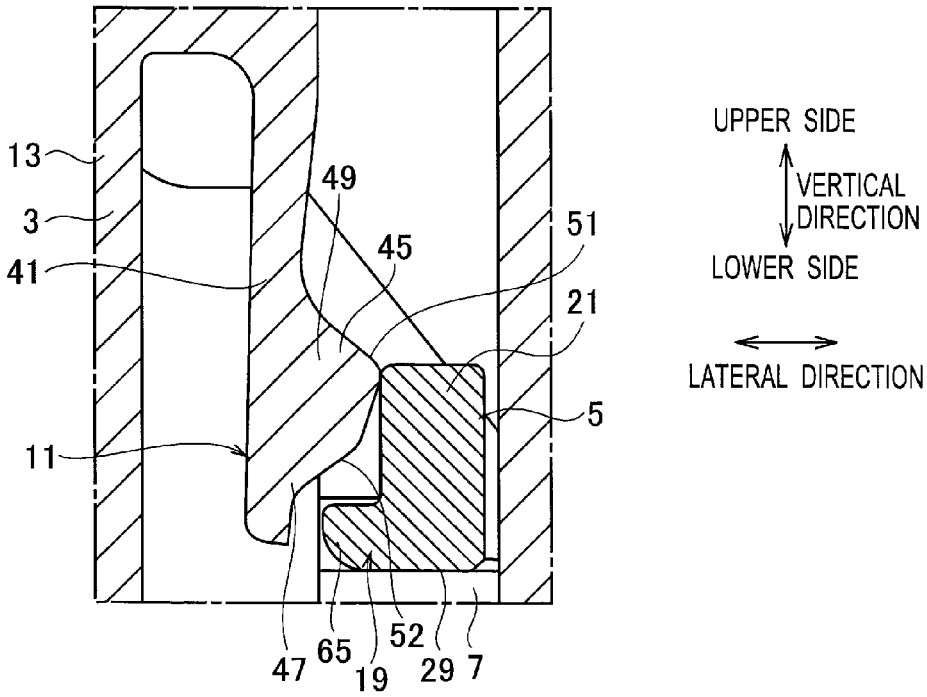
FIG. 28 is an enlarged view of a portion XXIII in FIG. 25.
Figure 29:
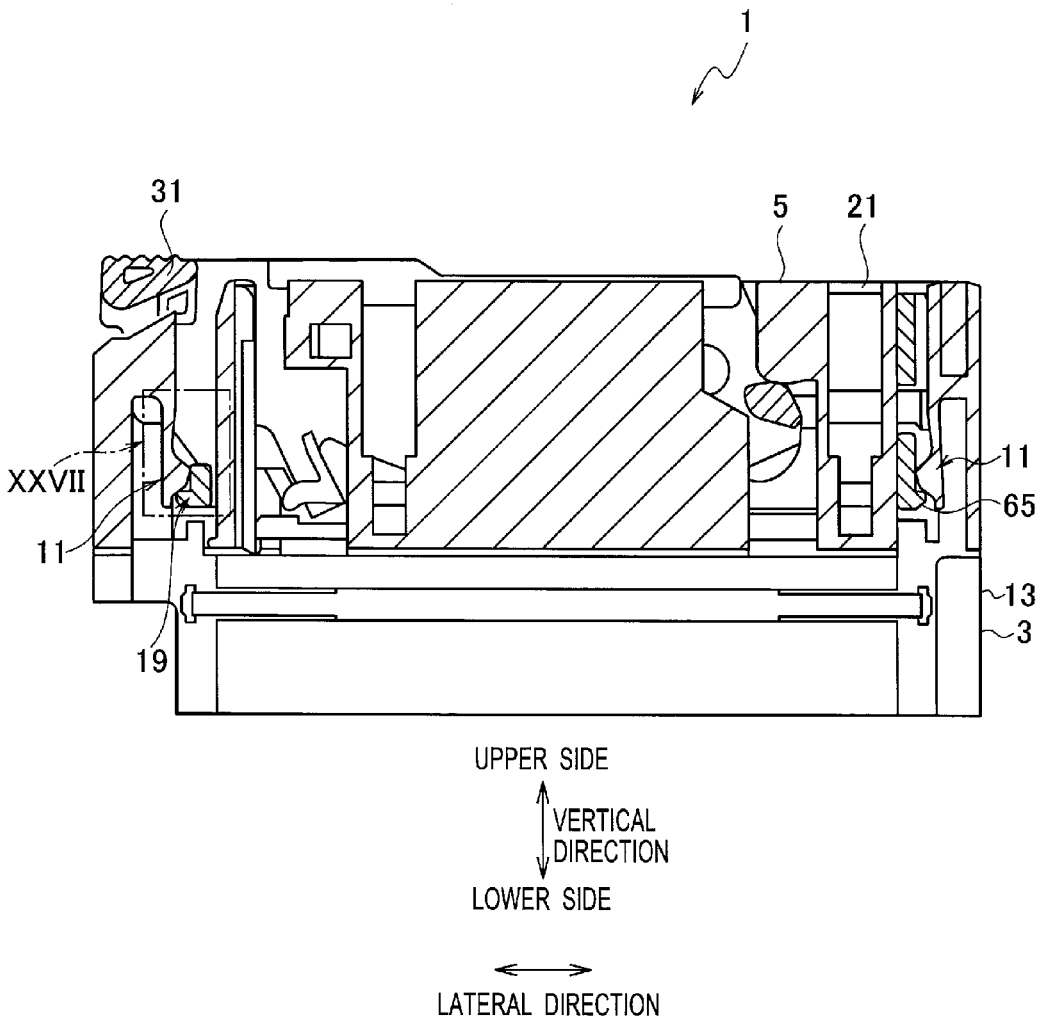
FIG. 29 is a view showing the manner of operation of the connector according to the embodiment of the present invention.

Next, due to the further downward movement of the female connector 5, the projecting portion 65 of the engaging portion 19 of the female connector 5 comes over the pawl portion 43 and the contact portion 45 of the locking portion 11 of the male connector 3 so that the elastic arm 41 of the locking portion 11 of the male connector 3 is restored (see FIG. 27 and FIG. 28).

Further, the female connector 5 is brought into contact with the aligning plate 7 (as a result of pushing the aligning plate 7) so that the aligning plate 7 also moves downward, the projections (positioning projections) 35 of the engaged portion 15 of the aligning plate 7 are brought into contact with the engaging portion 33 of the male connector 3. As described above, the lower surface 23 of the aligning plate 7 is brought into contact with the upper surface 25 which is a portion of the male connector housing 13 from which male terminals project, and the upper surface 27 of the aligning plate 7 is brought into contact with the lower surface 29 which is a portion of the female connector housing 21 on which female terminals are formed so that the mounting of the aligning plate 7 and the female connector 5 in the male connector 3 is finished (see FIG. 26).

In a state where the mounting of the aligning plate 7 and the female connector 5 in the male connector 3 is finished, the projecting portion 65 of the engaging portion 19 of the female connector 5 is positioned below the pawl portion 63 and the projections 35 of the engaged portion 15 of the aligning plate 7, and the projecting portion 65 of the engaging portion 19 of the female connector 5 is positioned below the contact portion 45 and the pawl portion 43 of the locking portion 11 of the male connector 3.

The connector 1 is configured such that the female connector 5 and the aligning plate 7 are removed from the male connector 3 through the following operations.

In removing the aligning plate 7 and the female connector 5 from a state where the mounting of the aligning plate 7 and the female connector 5 in the male connector 3 is finished (from a state where the aligning plate 7 and the female connector 5 are connected to the male connector 3), the female connector 5 moves upward by pulling up the lever 31 (by rotating the lever 31 upward).

Due to the upward movement of the female connector 5, firstly, the projecting portion 65 of the engaging portion 19 of the female connector 5 is brought into contact with the pawl portion 63 of the engaged portion 15 of the aligning plate 7. Since the projections 35 are brought into contact with the engaging portion 33 of the male connector 3, the elastic arm 61 of the engaged portion 15 of the aligning plate 7 is not deformed even when such a contact is made, (see FIG. 26 and the like) and hence, the aligning plate 7 also moves upward.

Figure 35:
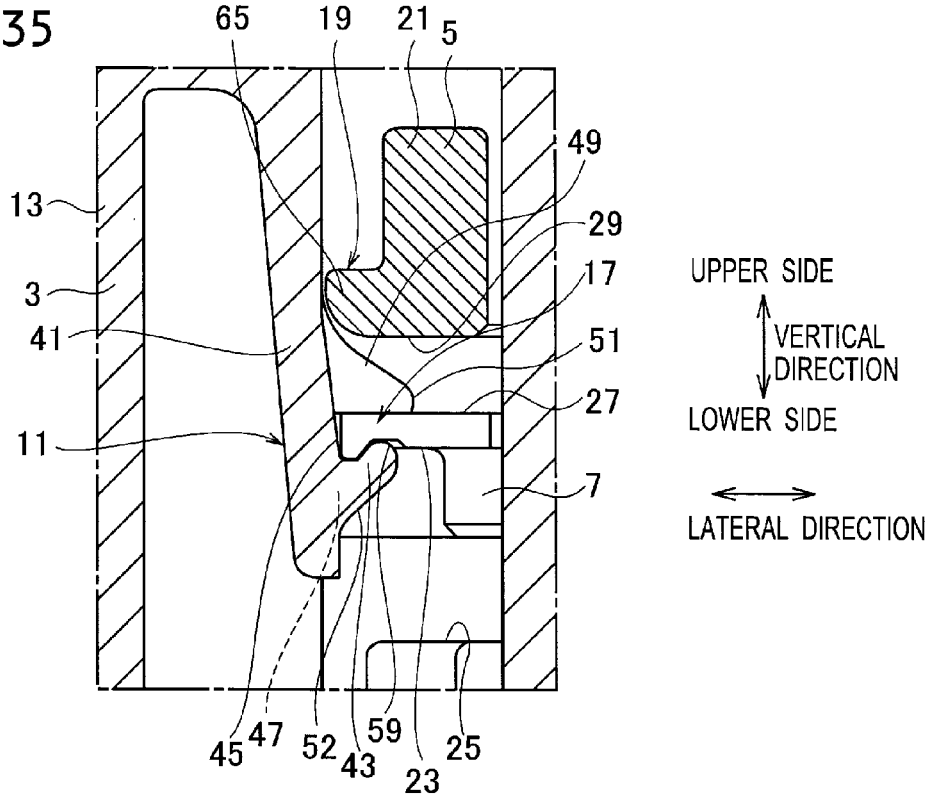
FIG. 35 is a view showing an engagement state of the engaging portion of the male connector, the engaging portion of the female connector, and the locked portion of the aligning plate in a state shown in FIG. 33.
Figure 36:
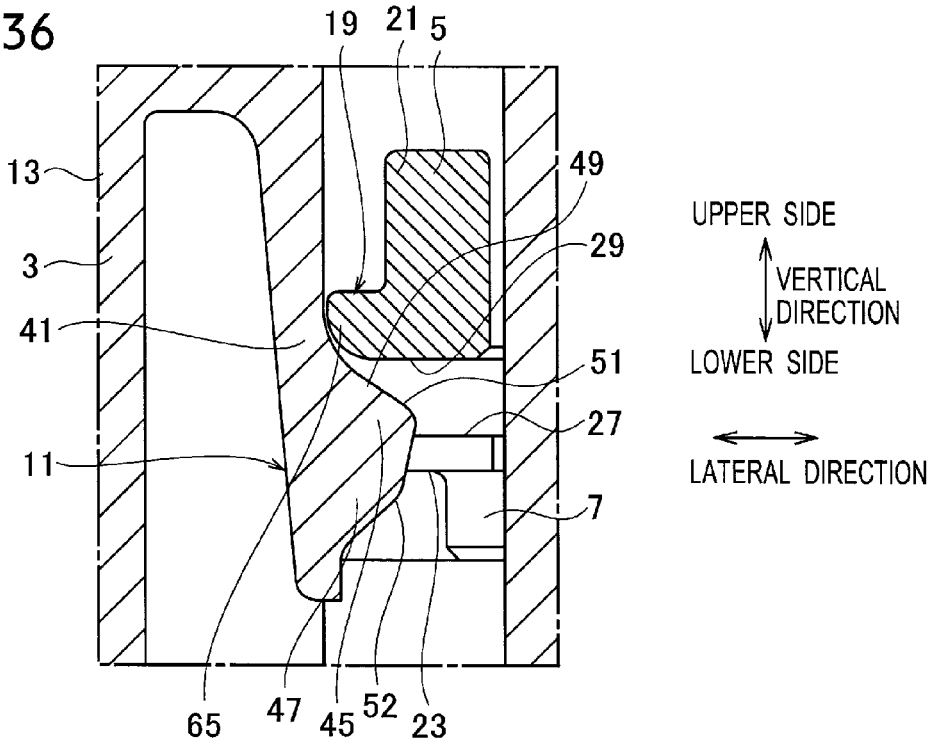
FIG. 36 is an enlarged view of an XXXI portion in FIG. 33.

Subsequently, due to the further upward movement of the female connector 5, the projecting portion 65 of the engaging portion 19 of the female connector 5 is brought into contact with the contact portion 45 of the locking portion 11 of the male connector 3, the elastic arm 41 of the locking portion 11 of the male connector 3 is deflected outward, the projecting portion 65 of the engaging portion 19 of the female connector 5 comes over the pawl portion 43 and the contact portion 45 of the locking portion 11 of the male connector 3 so that the elastic arm 41 of the locking portion 11 of the male connector 3 is restored, and the pawl portion 43 of the locking portion 11 of the male connector 3 enters the recessed portion 59 of the locked portion 17 of the aligning plate 7 so that the projecting portion 65 of the engaging portion 19 of the female connector 5 is positioned above the pawl portion 43 and the contact portion 45 of the locking portion 11 of the male connector 3 (see FIG. 35 and FIG. 36).

Then, due to the further upward movement of the female connector 5, the female connector 5 and the aligning plate 7 further move upward while maintaining a state where the projecting portion 65 of the engaging portion 19 of the female connector 5 is brought into contact with the pawl portion 63 of the engaged portion 15 of the aligning plate 7 so that the removal of the female connector 5 and the aligning plate 7 from the male connector 3 is completed.

Figure 34:
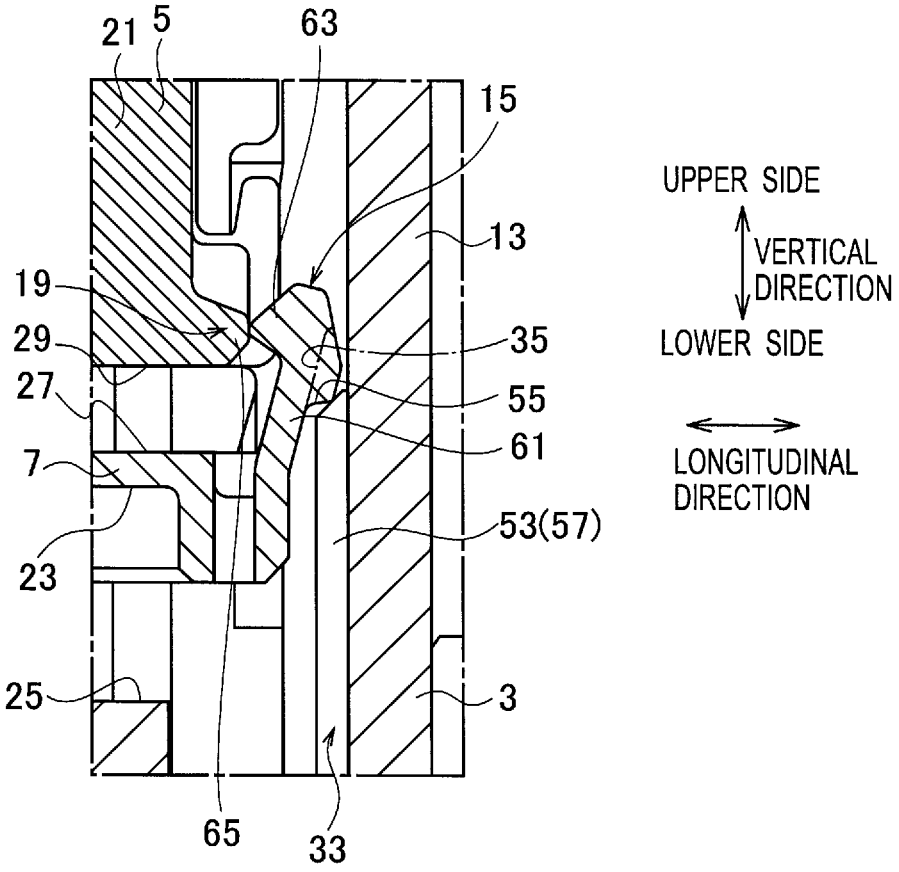
FIG. 34 is a view showing an engagement state of the engaging portion (deformation preventing rib) of the male connector, the engaging portion of the female connector, and the engaged portion of the aligning plate in a state shown in FIG. 33.

The connector 1 may be configured such that in removing the female connector 5 from the male connector 3 by moving the female connector 5 upward, as shown in FIG. 34, the elastic arm 61 of the engaged portion 15 of the aligning plate 7 is elastically deformed outward so that the aligning plate 7 is kept in the above-described temporary mounted state.

The connector 1 is configured such that, in a state where the aligning plate 7 is temporarily mounted in the male connector 3, the locked portion 17 which is formed on the lower surface of the aligning plate 7 is brought into contact with the locking portion 11 of the male connector 3, the aligning plate 7 is supported on the male connector 3 from below, and the downward movement of the aligning plate 7 is prevented. Accordingly, even when a strong force (load) is applied to the connector 1 in a temporary mounted state, there is no possibility that the aligning plate 7 is moved toward the male connector 3 (a lower side) whereby there is no possibility that the aligning plate 7 is erroneously mounted in the male connector 3.

The connector 1 is configured such that in removing the female connector 5 from the male connector 3 by moving the female connector 5 upward from the state where the female connector 5 and the aligning plate 7 are mounted in the male connector 3, the engaging portion 19 of the female connector 5 engages with the engaged portion 15 of the aligning plate 7, and the aligning plate 7 moves toward a side away from the male connector 3 together with the female connector 5. Accordingly, the aligning plate 7, once mounted, can be easily removed (pulled up) from the male connector 3.

Further, with such a configuration, the connector 1 can easily acquire both a function of eliminating the possibility that the temporarily-mounted aligning plate 7 inadvertently moves toward the male connector 3 (downward) and a function of facilitating the removal (pulling up) of the aligning plate 7, once mounted, from the male connector 3 even when the size tolerance is taken into account (even when an irregularity in size tolerance among the male connector 3, the female connector 5 and the aligning plate 7 is more or less large).

Further, the connector 1 is configured such that in removing the female connector 5 from the male connector 3 by moving the female connector 5 upward from the state where the female connector 5 is mounted in the male connector 3, the engaging portion 19 of the female connector 5 keeps engagement with the engaged portion 15 of the aligning plate 7 until the aligning plate 7 is completely separated from the male connector 3. Accordingly, the aligning plate 7, once mounted, can be easily and completely removed (pulled up) from the male connector 3.

Further, the connector 1 is configured such that the engaging portion 19 of the female connector 5 is brought into contact with the locking portion 11 of the male connector 3 so that a state where the locked portion 17 of the aligning plate 7 is locked to the locking portion 11 of the male connector 3 (the temporary mounted state) is released. Accordingly, the configuration of the connector 1 can be simplified.

Further, the connector 1 is configured such that the aligning plate 7 is positioned with respect to the male connector 3 in a longitudinal direction by making the engaged portion 15 of the aligning plate 7 engage with the engaging portion 33 of the male connector 3, and the aligning plate 7 is positioned with respect to the male connector 3 in a lateral direction due to locking of the locked portion 17 of the aligning plate 7 to the locking portion 11 of the male connector 3. Accordingly, the configuration of the connector 1 can be simplified.

Although the embodiment of the present invention has been described heretofore, the embodiment is merely exemplified for facilitating the understanding of the present invention, and the present invention is not limited to the embodiment. The technical scope of the present invention may include not only the specific technical matters disclosed in the above-described embodiment but also various modifications, changes, and alternative techniques easily derived from the above-described specific technical matters.

What is claimed is:

1. A connector comprising:

a male connector;

an aligning plate; and a female connector, wherein the male connector includes a male terminal and a locking portion, the aligning plate is configured such that the aligning plate engages with the male terminal so as to perform at least one of the protection of the male terminal and the correction of alignment of the male terminal, the aligning plate is movable relative to the male connector in a projecting direction of the male terminal, the aligning plate includes a engaged portion and a locked portion formed on a surface faced to a proximal end side of the male terminals, and the locked portion is brought into contact with the locking portion of the male connector in a state where the aligning plate is temporarily mounted in the male connector thus preventing the movement of the male terminal toward the proximal end, and the female connector is configured such that the female connector is mounted on the male connector together with the aligning plate by moving toward the male connecter side, the female connector includes an engaging portion, and in removal of the female connector from the male connector due to the movement of the female connector toward a side away from the male connector from a state where the female connector is mounted on the male connector, the engaging portion engages with the engaged portion of the aligning plate, and the aligning plate is moved toward a side away from the male connector, wherein an engaging portion is formed on the male connector, a projection is formed on the engaged portion of the aligning plate, and the connector is configured such that in mounting the female connector on the male connector by moving the female connector toward the male connector side, the engaging portion of the female connector is brought into contact with a locking portion of the male connector so that a state where the locked portion of the aligning plate is locked to the locking portion of the male connector is released, and the connector is also configured such that until releasing of the state where the locked portion of the aligning plate is locked to the locking portion of the male connector is finished, the projection of the engaged portion of the aligning plate is brought into contact with the engaging portion of the male connector thus preventing movement of the aligning plate toward a proximal end side of the male terminals.

2. The connector according to claim 1, wherein the connector is configured such that in the removal of the female connector from the male connector due to the movement of the female connector toward a side away from the male connector from a state where the female connector is connected to the male connector, the engaging portion of the female connector continuously engages with the engaged portion of the aligning plate until the aligning plate is away from the male connector together with the female connector.

3. The connector according to claim 1, wherein the aligning plate is formed into a rectangular flat plate shape, the connector is configured such that the aligning plate is positioned with respect to the male connector in a longitudinal direction which is one predetermined direction orthogonal to a moving direction of the female connector with respect to the male connector by making the engaged portion of the aligning plate engage with the engaging portion of the male connector, and the connector is configured such that the aligning plate is positioned with respect to the male connector in a lateral direction which is a direction orthogonal to the moving direction of the female connector with respect to the male connector and the longitudinal direction due to at least one of locking between the locked portion of the aligning plate and the locking portion of the male connector and engagement between both ends of the aligning plate in the lateral direction and the locking portion of the male connector.

* * * * *